US011634965B2

(12) United States Patent
Slup et al.

(10) Patent No.: US 11,634,965 B2
(45) Date of Patent: Apr. 25, 2023

(54) DOWNHOLE TOOL AND METHOD OF USE

(71) Applicant: The WellBoss Company, LLC, Houston, TX (US)

(72) Inventors: Gabriel Antoniu Slup, Spring, TX (US); Evan Lloyd Davies, Houston, TX (US); Martin Paul Coronado, Fulshear, TX (US); Luis Miguel Avila, Pearland, TX (US)

(73) Assignee: The WellBoss Company, LLC, Houston, TX (US)

( * ) Notice: Subject to any disclaimer, the term of this patent is extended or adjusted under 35 U.S.C. 154(b) by 16 days.

(21) Appl. No.: 17/072,287

(22) Filed: Oct. 16, 2020

(65) Prior Publication Data

US 2021/0115753 A1 Apr. 22, 2021

Related U.S. Application Data

(60) Provisional application No. 63/035,575, filed on Jun. 5, 2020, provisional application No. 62/916,034, filed on Oct. 16, 2019.

(51) Int. Cl.
*E21B 33/129* (2006.01)
*E21B 23/01* (2006.01)

(52) U.S. Cl.
CPC ..... *E21B 33/1293* (2013.01); *E21B 23/01* (2013.01); *E21B 2200/08* (2020.05)

(58) Field of Classification Search
CPC ... E21B 33/1298; E21B 23/01; E21B 2200/08
See application file for complete search history.

(56) References Cited

U.S. PATENT DOCUMENTS

| | | | |
|---|---|---|---|
| 2,230,712 | A | 2/1941 | Bendeler et al. |
| 2,683,492 | A | 7/1954 | Baker |
| 2,797,758 | A | 7/1957 | Showalter |
| 3,163,225 | A | 12/1964 | Perkins |
| 3,343,607 | A | 9/1967 | Current |
| 3,422,898 | A | 1/1969 | Conrad |
| 3,687,196 | A | 8/1972 | Mullins |
| 3,769,127 | A | 10/1973 | Goldsworthy et al. |
| 3,776,561 | A | 12/1973 | Haney |
| 4,359,090 | A | 11/1982 | Luke |
| 4,388,971 | A | 6/1983 | Peterson |
| 4,436,150 | A | 3/1984 | Barker |
| 4,437,516 | A | 3/1984 | Cockrell |
| 4,440,223 | A | 4/1984 | Akkerman |
| 4,469,172 | A | 9/1984 | Clark |

(Continued)

FOREIGN PATENT DOCUMENTS

| | | |
|---|---|---|
| EP | 0136659 | 4/1985 |
| EP | 0504848 | 9/1992 |

(Continued)

*Primary Examiner* — Taras P Bemko
*Assistant Examiner* — Ronald R Runyan
(74) *Attorney, Agent, or Firm* — Kearney, McWilliams & Davis, PLLC; John M. DeBoer

(57) ABSTRACT

A downhole tool suitable for use in a wellbore, the tool having a double cone having a dual-cone outer surface. The downhole tool includes a carrier ring disposed around one end of the double cone, and a slip disposed around or proximate to an other end of the double cone. There is a guide assembly engaged with the slip.

17 Claims, 13 Drawing Sheets

(56) References Cited

U.S. PATENT DOCUMENTS 4,630,690 A 12/1986 Beasley et al.
4,711,300 A 12/1987 Wardlaw et al.
4,784,226 A 11/1988 Wyatt
5,025,858 A 6/1991 Glaser
5,048,606 A 9/1991 Allwin
5,113,940 A 5/1992 Glaser
5,147,857 A 9/1992 Raddatz et al.
5,224,540 A 7/1993 Streich et al.
5,246,069 A 9/1993 Glaser et al.
5,253,714 A 10/1993 Davis et al.
5,333,685 A 8/1994 Gilbert
5,376,200 A 12/1994 Hall
5,449,040 A 9/1995 Milner
5,484,040 A 1/1996 Penisson
5,819,846 A 10/1998 Bolt et al.
5,839,515 A 11/1998 Yuan et al.
5,842,517 A 12/1998 Coone
5,927,403 A 7/1999 Dallas
5,967,352 A 10/1999 Repp
5,984,007 A 11/1999 Yuan
6,164,377 A * 12/2000 Roberts ..... E21B 7/06 166/118
6,167,963 B1 1/2001 McMahan et al.
6,241,018 B1 6/2001 Eriksen
6,353,771 B1 3/2002 Southland
6,354,372 B1 3/2002 Carisella et al.
6,425,442 B1 7/2002 Latiolais et al.
6,491,116 B2 12/2002 Berscheidt et al.
6,578,638 B2 6/2003 Guillory
6,708,768 B2 3/2004 Slup et al.
6,712,153 B2 3/2004 Turley et al.
6,899,181 B2 5/2005 Simpson et al.
7,044,230 B2 5/2006 Starr et al.
7,087,109 B2 8/2006 Bredt et al.
7,093,664 B2 8/2006 Todd et al.
7,255,178 B2 8/2007 Slup et al.
7,350,569 B2 4/2008 Collins et al.
7,350,582 B2 4/2008 McKeachnie et al.
7,475,736 B2 1/2009 Lehr et al.
7,484,940 B2 2/2009 O'Neill
7,735,549 B1 6/2010 Nish et al.
7,740,079 B2 6/2010 Clayton et al.
7,753,416 B2 7/2010 Mazzaferro et al.
7,762,323 B2 7/2010 Frazier
7,980,300 B2 7/2011 Roberts et al.
8,002,030 B2 8/2011 Turley et al.
8,016,295 B2 9/2011 Guest et al.
8,079,413 B2 12/2011 Frazier
8,113,276 B2 2/2012 Greenlee et al.
8,127,851 B2 3/2012 Misselbrook
8,167,033 B2 5/2012 White
8,205,671 B1 6/2012 Branton
8,211,248 B2 7/2012 Marya
8,231,947 B2 7/2012 Vaidya et al.
8,267,177 B1 9/2012 Vogel et al.
D673,182 S 12/2012 Frazier
8,336,616 B1 12/2012 McClinton
8,381,809 B2 2/2013 White
8,459,346 B2 6/2013 Frazier
8,469,088 B2 6/2013 Shkurti et al.
8,567,492 B2 10/2013 White
8,596,347 B2 12/2013 Valencia et al.
8,839,855 B1 2/2014 McClinton et al.
8,770,276 B1 7/2014 Nish et al.
8,770,280 B2 7/2014 Buytaert et al.
8,839,869 B2 9/2014 Porter et al.
8,887,818 B1 11/2014 Carr et al.
8,893,780 B2 11/2014 Greenlee et al.
9,416,617 B2 8/2016 Wiese et al.
9,708,878 B2 7/2017 Cooke, Jr.
9,714,551 B2 7/2017 Okura et al.
9,745,847 B2 8/2017 Ditzler et al.
9,790,763 B2 10/2017 Fripp et al.
D806,136 S 12/2017 Saulou et al.
9,845,658 B1 12/2017 Nish et al.
9,982,506 B2 5/2018 Walton et al.
2003/0188876 A1 10/2003 Vick et al.
2003/0226660 A1 12/2003 Winslow et al.
2003/0236173 A1 12/2003 Dobson et al.
2004/0003928 A1 1/2004 Frazier
2004/0045723 A1 3/2004 Slup et al.
2004/0216868 A1 11/2004 Owen, Sr.
2005/0109502 A1 5/2005 Buc Slay et al.
2005/0183864 A1 8/2005 Trinder
2005/0194141 A1 9/2005 Sinclair et al.
2006/0243455 A1 11/2006 Telfer
2007/0003449 A1 1/2007 Hatamian et al.
2007/0039742 A1 2/2007 Costa
2007/0119600 A1 5/2007 Slup et al.
2008/0128133 A1 6/2008 Turley et al.
2008/0196879 A1 8/2008 Broome et al.
2008/0264627 A1 10/2008 Roberts et al.
2008/0277162 A1 11/2008 DiFoggio
2009/0038790 A1 2/2009 Barlow
2009/0090516 A1 4/2009 Delucia et al.
2009/0229424 A1 9/2009 Montgomery
2009/0236091 A1 9/2009 Hammami et al.
2010/0155050 A1 6/2010 Frazier
2010/0263876 A1 10/2010 Frazier
2010/0276159 A1 11/2010 Mailand et al.
2010/0326660 A1 12/2010 Ballard et al.
2011/0024134 A1 2/2011 Buckner
2011/0048740 A1 3/2011 Ward et al.
2011/0048743 A1 3/2011 Stafford et al.
2011/0088891 A1 4/2011 Stout
2011/0094802 A1 4/2011 Vatne
2011/0186306 A1 8/2011 Marya et al.
2011/0232899 A1 9/2011 Porter
2011/0259610 A1 10/2011 Shkurti et al.
2011/0277989 A1 11/2011 Frazier
2011/0290473 A1 12/2011 Frazier
2012/0061105 A1 3/2012 Neer et al.
2012/0125642 A1 5/2012 Chenault et al.
2012/0181032 A1 7/2012 Naedler et al.
2012/0234538 A1 9/2012 Martin et al.
2012/0279700 A1 11/2012 Frazier
2013/0032357 A1 2/2013 Mazyar et al.
2013/0098600 A1 4/2013 Roberts
2013/0186647 A1 7/2013 Xu et al.
2013/0240201 A1 9/2013 Frazier
2013/0264056 A1 10/2013 Stout
2013/0299192 A1* 11/2013 Xu ..... E21B 33/13 166/382
2013/0306331 A1 11/2013 Bishop et al.
2014/0020911 A1 1/2014 Martinez
2014/0027127 A1 1/2014 Frazier et al.
2014/0045731 A1 2/2014 Daccord
2014/0090831 A1 4/2014 Young et al.
2014/0116677 A1 5/2014 Sherlin
2014/0120346 A1 5/2014 Rochen
2014/0190685 A1 7/2014 Frazier et al.
2014/0224476 A1 8/2014 Frazier
2014/0251641 A1 9/2014 Marya et al.
2014/0345875 A1 11/2014 Murphree et al.
2014/0345878 A1 11/2014 Murphree et al.
2014/0374163 A1 12/2014 Rui et al.
2015/0013996 A1 1/2015 Davies et al.
2015/0027737 A1 1/2015 Rochen et al.
2015/0068728 A1 3/2015 Stage et al.
2015/0083394 A1 3/2015 Skarsen et al.
2015/0144348 A1 5/2015 Okura et al.
2015/0239795 A1 8/2015 Doud et al.
2015/0252638 A1 9/2015 Richards et al.
2015/0275070 A1 10/2015 Getzlaf et al.
2015/0354313 A1 12/2015 McClinton et al.
2015/0368994 A1 12/2015 Mhaskar et al.
2016/0115759 A1 4/2016 Richards et al.
2016/0122617 A1 5/2016 Murphree et al.
2016/0123104 A1 5/2016 Harris
2016/0130906 A1 5/2016 Garvey et al.
2016/0160591 A1 6/2016 Xu et al.
2016/0201427 A1 7/2016 Fripp et al.
2016/0265305 A1 9/2016 Davies et al.
2016/0281458 A1 9/2016 Greenlee

(56) References Cited

U.S. PATENT DOCUMENTS

| | | | | |
|---|---|---|---|---|
| 2016/0305215 | A1 | 10/2016 | Harris et al. | |
| 2016/0376869 | A1 | 12/2016 | Rochen et al. | |
| 2017/0044859 | A1 | 2/2017 | Blair | |
| 2017/0101836 | A1 | 4/2017 | Webster et al. | |
| 2017/0130553 | A1 | 5/2017 | Harris et al. | |
| 2017/0175488 | A1 | 6/2017 | Lisowski et al. | |
| 2017/0183950 | A1 | 6/2017 | Gillis et al. | |
| 2017/0260824 | A1 | 9/2017 | Kellner et al. | |
| 2017/0260825 | A1 | 9/2017 | Schmidt et al. | |
| 2017/0284167 | A1 | 10/2017 | Takahashi et al. | |
| 2017/0321514 | A1 | 11/2017 | Crow | |
| 2018/0135369 | A1* | 5/2018 | Parekh | C04B 35/565 |
| 2018/0171745 | A1 | 6/2018 | Jones | |
| 2019/0162044 | A1 | 5/2019 | Dirocco | |

FOREIGN PATENT DOCUMENTS

| | | |
|---|---|---|
| EP | 0890706 | 1/1993 |
| EP | 1643602 | 4/2006 |
| WO | 2007014339 | 2/2007 |
| WO | 2008100644 | 8/2008 |
| WO | 20091128853 | 9/2009 |
| WO | 2011097091 | 8/2011 |
| WO | 2011160183 | 12/2011 |
| WO | 2014197827 | 12/2014 |
| WO | 2016032761 | 3/2016 |
| WO | 2016182545 | 11/2016 |

* cited by examiner

DOWNHOLE TOOL AND METHOD OF USE

INCORPORATION BY REFERENCE

The subject matter of U.S. non-provisional application Ser. No. 15/876,120, filed Jan. 20, 2018, Ser. Nos. 15/898,753 and 15/899,147, each filed Feb. 19, 2018, and Ser. No. 15/904,468, filed Feb. 26, 2018, is incorporated herein by reference in entirety for all purposes, including with particular respect to a composition of matter (or material of construction) for a (sub)component for a downhole tool. The subject matter of each of U.S. provisional application Ser. No. 62/916,034, filed Oct. 16, 2019, and 63/035,575, filed Jun. 5, 2020, is incorporated herein by reference in entirety for all purposes. One or more of these applications may be referred to herein as the "Applications".

STATEMENT REGARDING FEDERALLY SPONSORED RESEARCH OR DEVELOPMENT

Not applicable.

BACKGROUND

Field of the Disclosure

This disclosure generally relates to downhole tools and related systems and methods used in oil and gas wellbores. More specifically, the disclosure relates to a downhole system and tool that may be run into a wellbore and useable for wellbore isolation, and methods pertaining to the same. In particular embodiments, the downhole tool may be of drillable materials.

Background of the Disclosure

An oil or gas well includes a wellbore extending into a subterranean formation at some depth below a surface (e.g., Earth's surface), and is usually lined with a tubular, such as casing, to add strength to the well. Many commercially viable hydrocarbon sources are found in "tight" reservoirs, which means the target hydrocarbon product may not be easily extracted. The surrounding formation (e.g., shale) to these reservoirs typically has low permeability, and it is uneconomical to produce the hydrocarbons (i.e., gas, oil, etc.) in commercial quantities from this formation without the use of drilling accompanied with fracing operations.

Fracing now has a significant presence in the industry, and is commonly understood to include the use of some type of plug set in the wellbore below or beyond the respective target zone, followed by pumping or injecting high pressure frac fluid into the zone. For economic reasons, fracing (and any associated or peripheral operation) is now ultra-competitive, and in order to stay competitive innovation is paramount. A frac plug and accompanying operation may be such as described or otherwise disclosed in U.S. Pat. No. 8,955,605, incorporated by reference herein in its entirety for all purposes.

FIG. 1 illustrates a conventional plugging system 100 that includes use of a downhole tool 102 used for plugging a section of the wellbore 106 drilled into formation 110. The tool or plug 102 may be lowered into the wellbore 106 by way of workstring 112 (e.g., e-line, wireline, coiled tubing, etc.) and/or with setting tool 117, as applicable. The tool 102 generally includes a body 103 with a compressible seal member 122 to seal the tool 102 against an inner surface 107 of a surrounding tubular, such as casing 108. The tool 102 may include the seal member 122 disposed between one or more slips 109, 111 that are used to help retain the tool 102 in place.

In operation, forces (usually axial relative to the wellbore 106) are applied to the slip(s) 109, 111 and the body 103. As the setting sequence progresses, slip 109 moves in relation to the body 103 and slip 111, the seal member 122 is actuated, and the slips 109, 111 are driven against corresponding conical surfaces 104. This movement axially compresses and/or radially expands the compressible member 122, and the slips 109, 111, which results in these components being urged outward from the tool 102 to contact the inner wall 107. In this manner, the tool 102 provides a seal expected to prevent transfer of fluids from one section 113 of the wellbore across or through the tool 102 to another section 115 (or vice versa, etc.), or to the surface. Tool 102 may also include an interior passage (not shown) that allows fluid communication between section 113 and section 115 when desired by the user. Oftentimes multiple sections are isolated by way of one or more additional plugs (e.g., 102A).

The setting tool 117 is incorporated into the workstring 112 along with the downhole tool 102. Examples of commercial setting tools include the Baker #10 and #20, and the 'Owens Go'. Upon proper setting, the plug may be subjected to high or extreme pressure and temperature conditions, which means the plug must be capable of withstanding these conditions without destruction of the plug or the seal formed by the seal element. High temperatures are generally defined as downhole temperatures above 200° F., and high pressures are generally defined as downhole pressures above 7,500 psi, and even in excess of 15,000 psi. Extreme wellbore conditions may also include high and low pH environments. In these conditions, conventional tools, including those with compressible seal elements, may become ineffective from degradation. For example, the sealing element may melt, solidify, or otherwise lose elasticity, resulting in a loss the ability to form a seal barrier.

Before production operations may commence, conventional plugs typically require some kind of removal process, such as milling or drilling. Drilling typically entails drilling through the set plug, but in some instances the plug can be removed from the wellbore essentially intact (i.e., retrieval). A common problem with retrievable plugs is the accumulation of debris on the top of the plug, which may make it difficult or impossible to engage and remove the plug. Such debris accumulation may also adversely affect the relative movement of various parts within the plug. Furthermore, with current retrieving tools, jarring motions or friction against the well casing may cause accidental unlatching of the retrieving tool (resulting in the tools slipping further into the wellbore), or re-locking of the plug (due to activation of the plug anchor elements). Problems such as these often make it necessary to drill out a plug that was intended to be retrievable.

However, because plugs are required to withstand extreme downhole conditions, they are built for durability and toughness, which often makes the drill-through process difficult, time-consuming, and/or require considerable expertise. Even drillable plugs are typically constructed of a metal such as cast iron that may be drilled out with a drill bit at the end of a drill string. Steel may also be used in the structural body of the plug to provide structural strength to set the tool. The more metal parts used in the tool, the longer the drilling operation takes. Because metallic components are harder to drill through, this process may require additional trips into and out of the wellbore to replace worn out drill bits.

Composite materials, such as filament wound materials, have enjoyed success in the frac industry because of easy-to-drill tendencies. The process of making filament wound materials is known in the art, and although subject to differences, typically entails a known process. However, even composite plugs require drilling, or often have one or more pieces of metal (sometimes hardened metal).

The use of plugs in a wellbore is not without other problems, as these tools are subject to known failure modes. When the plug is run into position, the slips have a tendency to pre-set before the plug reaches its destination, resulting in damage to the casing and operational delays. Pre-set may result, for example, because of residue or debris (e.g., sand) left from a previous frac. In addition, conventional plugs are known to provide poor sealing, not only with the casing, but also between the plug's components. For example, when the sealing element is placed under compression, its surfaces do not always seal properly with surrounding components (e.g., cones, etc.).

Downhole tools are often activated with a drop ball that is flowed from the surface down to the tool, whereby the pressure of the fluid must be enough to overcome the static pressure and buoyant forces of the wellbore fluid(s) in order for the ball to reach the tool. Frac fluid is also highly pressurized in order to not only transport the fluid into and through the wellbore, but also extend into the formation in order to cause fracture. Accordingly, a downhole tool must be able to withstand these additional higher pressures.

It is naturally desirable to "flow back," i.e., from the formation to the surface, the injected fluid, or the formation fluid(s); however, this is not possible until the previously set tool or its blockage is removed. Removal of tools (or blockage) usually requires a well-intervention service for retrieval or drill-through, which is time consuming, costly, and adds a potential risk of wellbore damage.

The more metal parts used in the tool, the longer the drill-through operation takes. Because metallic components are harder to drill, such an operation may require additional trips into and out of the wellbore to replace worn out drill bits.

In the interest of cost-saving, materials that react under certain downhole conditions have been the subject of significant research in view of the potential offered to the oilfield industry. For example, such an advanced material that has an ability to degrade by mere response to a change in its surrounding is desirable because no, or limited, intervention would be necessary for removal or actuation to occur.

Such a material, essentially self-actuated by changes in its surrounding (e.g., the presence a specific fluid, a change in temperature, and/or a change in pressure, etc.) may potentially replace costly and complicated designs and may be most advantageous in situations where accessibility is limited or even considered to be impossible, which is the case in a downhole (subterranean) environment. However, these materials tend to be exotic, rendering related tools made of such materials undesirable as a result of high cost.

Conventional, and even modern, tools require an amount of materials and components that still result in a set tool being in excess of twenty inches. A shorter tool means less materials, less parts, reduced removal time, and easier to deploy.

The ability to save cost on materials and/or operational time (and those saving operational costs) leads to considerable competition in the marketplace. Achieving any ability to save time, or ultimately cost, leads to an immediate competitive advantage.

Accordingly, there are needs in the art for novel systems and methods for isolating wellbores in a fast, viable, and economical fashion. Moreover, it remains desirable to have a downhole tool that provides a larger flowbore, but still able to withstand setting forces. There is a great need in the art for downhole plugging tools that form a reliable and resilient seal against a surrounding tubular that use less materials, less parts, have reduced or eliminated removal time, and are easier to deploy, even in the presence of extreme wellbore conditions. There is also a need for a downhole tool made substantially of a drillable material that is easier and faster to drill, or outright eliminates a need for drill-thru.

SUMMARY

Embodiments of the disclosure pertain to a downhole tool for use in a wellbore that may include any of the following: a double cone comprising: a distal end; a proximate end; and an outer surface. There may be a carrier ring slidingly engaged with the distal end. The carrier ring may include an outer seal element groove. There may be a slip engaged with the proximate end. There may be a lower sleeve or guide assembly coupled, or proximate, with the slip.

The double cone may be dual-frustoconical in shape. As such, the outer surface may include a first angled surface and a second angled surface. The first angled surface may include a first plane that in cross section bisects a longitudinal axis a first angle range of 5 degrees to 40 degrees. The second angled surface may be negative to the first angled surface. In aspects, the second angled surface may include a second plane that in cross section bisects the longitudinal angle negative to that of the first angle. The second angle may be in a second angle range of 5 degrees to 40 degrees.

The slip may include an at least one slip groove that forms a lateral opening in the slip. The slip groove may be defined by a depth that extends from a slip outer surface to a slip inner surface. There may be a seal element disposed in the outer seal element groove.

Any component of the downhole tool may be made of a composite material. Any component of the downhole tool may be made of a dissolvable material, which may be composite- or metal-based.

The slip may include an at least one primary fracture point and an at least one secondary fracture point. The carrier ring may be configured to elongate by about 10% to 20% with respect to its original shape. The carrier ring may elongate without fracturing.

The downhole tool (or double cone) may have an inner flowbore. The inner flowbore may have an inner diameter in a bore range of about 1 inch to 6 inches.

The lower sleeve or guide assembly may have a shear tab or shear threads. In aspects, the seal element may not be engaged or otherwise directly in contact with a cone. In aspects, a longitudinal length of the downhole tool after setting may be in a set length range of about 5 inches to about 15 inches. The length may be about 5 inches to 20 inches.

The double cone may include a ball seat formed within an inner flowbore. The double cone may have a ball cavity. In an assembled or run-in position, there may be a ball disposed in the ball cavity.

Other embodiments of the disclosure pertain to a downhole setting system for use in a wellbore that may include a workstring; a setting tool assembly coupled to the workstring; and a downhole tool coupled with the setting tool assembly.

The setting tool may include a tension mandrel having a first tension mandrel end and a second tension mandrel end. The setting tool assembly may include a setting sleeve. The setting sleeve may be a flex sleeve. The flex sleeve may include one or more collets (or dogs, fingers, etc.)

The downhole tool may include: a double cone comprising: a distal end; a proximate end; and an outer surface. The downhole tool may have a carrier ring slidingly engaged with the distal end. The carrier ring may include an outer seal element groove. There may be a seal element disposed in the outer seal element groove. There may be a slip engaged with the proximate end. There may be a lower sleeve or guide assembly coupled (or near, proximate, engaged, etc.) with the slip.

The tension mandrel may be disposed through the downhole tool. There may be a nose nut engaged with each of the second tension mandrel end and the guide insert.

The outer surface of the double cone may be dual frustoconical. Thus, there may be a first angled surface and a second angled surface. The first angled surface may include a first plane that in cross section bisects a longitudinal axis a first angle range of 5 degrees to 40 degrees. The second angled surface may include a second plane that in cross section bisects the longitudinal angle negative to that of the first angle. The second angle may be in a second angle range of (negative) 5 degrees to 40 degrees.

The double cone may include a ball seat formed within an inner flowbore.

Any component of the downhole tool may be made of a polymer-based material. Any component of the downhole tool may be made of a metallic-based material.

Embodiments of the disclosure pertain to a downhole tool suitable for use in a wellbore. The downhole tool may include a component, such as a cone, made of a reactive material, which may be composite-based. The cone may be a double cone configured with a distal end; a proximate end; and an outer surface.

The downhole tool may be about 4 inches to about 20 inches in longitudinal length. The downhole tool in its fully set position may be less than 15 inches in longitudinal length.

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1:
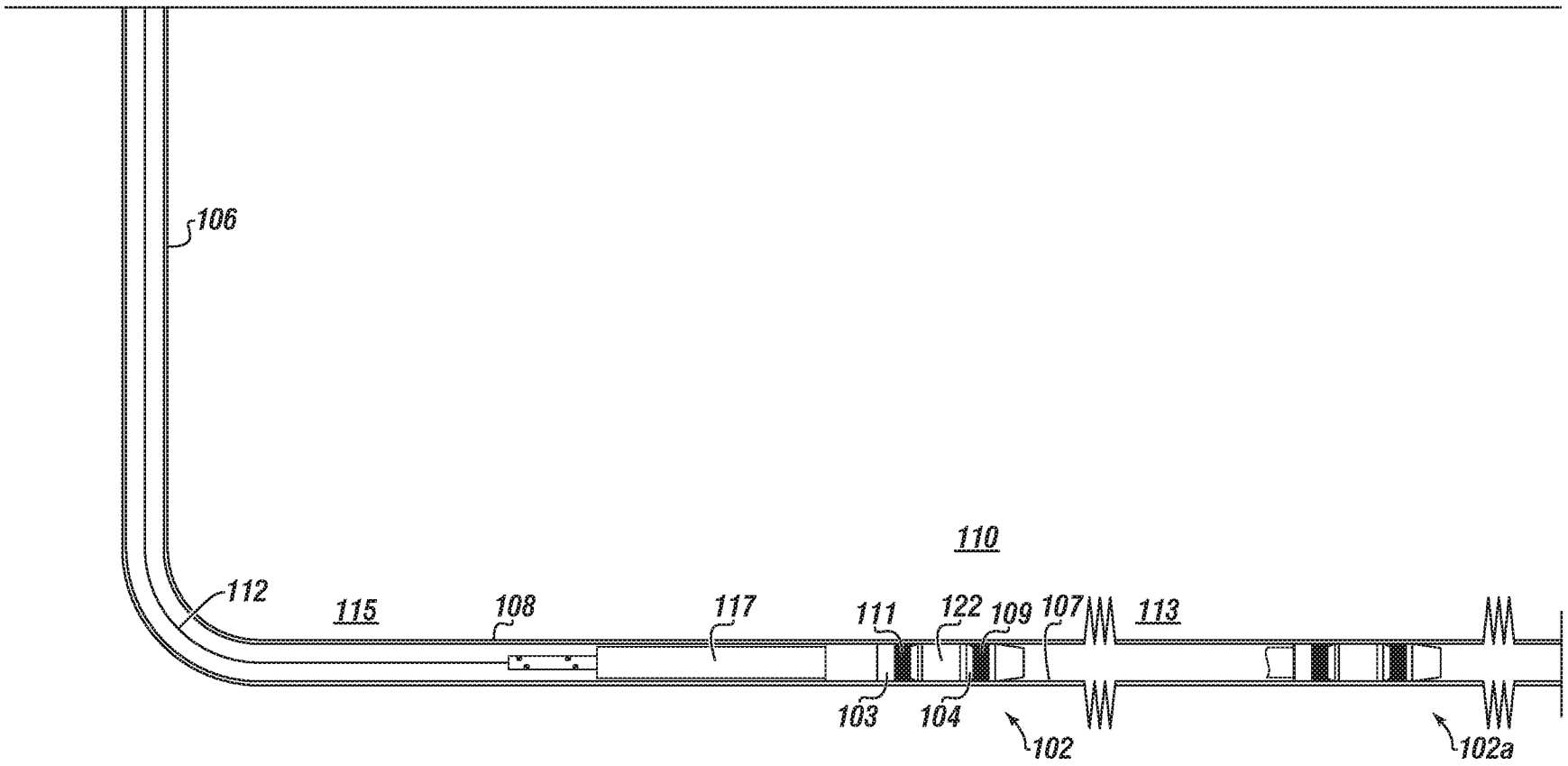
FIGURE 1 (PRIOR ART)
FIG. 1 is a side view of a process diagram of a conventional plugging system.

Herein disclosed are novel apparatuses, systems, and methods that pertain to and are usable for wellbore operations, details of which are described herein.

Embodiments of the present disclosure are described in detail in a non-limiting manner with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," "right", "left", "down", etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components that may be new, used, and/or retrofitted.

Various equipment may be in fluid communication directly or indirectly with other equipment. Fluid communication may occur via one or more transfer lines and respective connectors, couplings, valving, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, temperature, pressure, distance, melt index, etc., is from 100 to 1,000, it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Others may be implied or inferred.

Embodiments herein may be described at the macro level, especially from an ornamental or visual appearance. Thus, a dimension, such as length, may be described as having a certain numerical unit, albeit with or without attribution of a particular significant figure. One of skill in the art would appreciate that the dimension of "2 centimeters" may not be exactly 2 centimeters, and that at the micro-level may deviate. Similarly, reference to a "uniform" dimension, such as thickness, need not refer to completely, exactly uniform. Thus, a uniform or equal thickness of "1 millimeter" may have discernable variation at the micro-level within a certain tolerance (e.g., 0.001 millimeter) related to imprecision in measuring and fabrication.

Terms

The term "connected" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, multi-phase, etc. and is not limited to any particular type of fluid such as hydrocarbons.

The term "fluid connection", "fluid communication," "fluidly communicable," and the like, as used herein may refer to two or more components, systems, etc. being coupled whereby fluid from one may flow or otherwise be transferrable to the other. The coupling may be direct or indirect. For example, valves, flow meters, pumps, mixing tanks, holding tanks, tubulars, separation systems, and the like may be disposed between two or more components that are in fluid communication.

The term "pipe", "conduit", "line", "tubular", or the like as used herein may refer to any fluid transmission means, and may be tubular in nature.

The term "composition" or "composition of matter" as used herein may refer to one or more ingredients, components, constituents, etc. that make up a material (or material of construction). Composition may refer to a flow stream, or the material of construction of a component of a downhole tool, of one or more chemical components.

The term "chemical" as used herein may analogously mean or be interchangeable to material, chemical material, ingredient, component, chemical component, element, substance, compound, chemical compound, molecule(s), constituent, and so forth and vice versa. Any 'chemical' discussed in the present disclosure need not refer to a 100% pure chemical. For example, although 'water' may be thought of as H2O, one of skill would appreciate various ions, salts, minerals, impurities, and other substances (including at the ppb level) may be present in 'water'. A chemical may include all isomeric forms and vice versa (for example, "hexane", includes all isomers of hexane individually or collectively).

The term "pump" as used herein may refer to a mechanical device suitable to use an action such as suction or pressure to raise or move liquids, compress gases, and so forth. 'Pump' can further refer to or include all necessary subcomponents operable together, such as impeller (or vanes, etc.), housing, drive shaft, bearings, etc. Although not always the case, 'pump' can further include reference to a driver, such as an engine and drive shaft. Types of pumps include gas powered, hydraulic, pneumatic, and electrical.

The term "frac operation" as used herein may refer to fractionation of a downhole well that has already been drilled. 'Frac operation' can also be referred to and interchangeable with the terms fractionation, hydrofracturing, hydrofracking, fracking, fracing, and frac. A frac operation can be land or water based.

The term "mounted" as used herein may refer to a connection between a respective component (or subcomponent) and another component (or another subcomponent), which can be fixed, movable, direct, indirect, and analogous to engaged, coupled, disposed, etc., and can be by screw, nut/bolt, weld, and so forth.

The term "reactive material" as used herein may refer a material with a composition of matter having properties and/or characteristics that result in the material responding to a change over time and/or under certain conditions. The term reactive material may encompass degradable, dissolvable, disassociatable, dissociable, and so on.

The term "degradable material" as used herein may refer to a composition of matter having properties and/or characteristics that, while subject to change over time and/or under certain conditions, lead to a change in the integrity of the material. As one example, the material may initially be hard, rigid, and strong at ambient or surface conditions, but over time (such as within about 12-36 hours) and under certain conditions (such as wellbore conditions), the material softens.

The term "dissolvable material" may be analogous to degradable material. The as used herein may refer to a composition of matter having properties and/or characteristics that, while subject to change over time and/or under certain conditions, lead to a change in the integrity of the material, including to the point of degrading, or partial or complete dissolution. As one example, the material may initially be hard, rigid, and strong at ambient or surface conditions, but over time (such as within about 12-36 hours) and under certain conditions (such as wellbore conditions), the material softens. As another example, the material may initially be hard, rigid, and strong at ambient or surface conditions, but over time (such as within about 12-36 hours) and under certain conditions (such as wellbore conditions), the material dissolves at least partially, and may dissolve completely. The material may dissolve via one or more mechanisms, such as oxidation, reduction, deterioration, go into solution, or otherwise lose sufficient mass and structural integrity.

The term "breakable material" as used herein may refer to a composition of matter having properties and/or characteristics that, while subject to change over time and/or under certain conditions, lead to brittleness. As one example, the material may be hard, rigid, and strong at ambient or surface conditions, but over time and under certain conditions, becomes brittle. The breakable material may experience breakage into multiple pieces, but not necessarily dissolution.

For some embodiments, a material of construction may include a composition of matter designed or otherwise having the inherent characteristic to react or change integrity or other physical attribute when exposed to certain wellbore conditions, such as a change in time, temperature, water, heat, pressure, solution, combinations thereof, etc. Heat may be present due to the temperature increase attributed to the natural temperature gradient of the earth, and water may already be present in existing wellbore fluids. The change in integrity may occur in a predetermined time period, which may vary from several minutes to several weeks. In aspects, the time period may be about 12 to about 36 hours.

The term "machined" can refer to a computer numerical control (CNC) process whereby a robot or machinist runs computer-operated equipment to create machine parts, tools and the like.

The term "plane" or "planar" as used herein may refer to any surface or shape that is flat, at least in cross-section. For example, a frusto-conical surface may appear to be planar in 2D cross-section. It should be understood that plane or planar need not refer to exact mathematical precision, but instead be contemplated as visual appearance to the naked eye. A plane or planar may be illustrated in 2D by way of a line.

The term "parallel" as used herein may refer to any surface or shape that may have a reference plane lying in the same direction as that of another. It should be understood that parallel need not refer to exact mathematical precision, but instead be contemplated as visual appearance to the naked eye.

The term "double cone" as used herein may refer to a tubular component having an at least one generally frusto-conical surface. The double cone may have an external surface that in cross section has a reference line/plane bisecting a reference axis at an angle. The double cone may be a dual (also "dual faced", "double faced, and the like) cone, meaning there may be a second external surface having a second reference line/plane bisecting the reference axis (in cross-section) at a second angle. The second angle may be negative to the first angle (e.g., +10 degrees for the first, −10 degrees for the second). The term "cone" may refer to a double cone.

Figure 2A:
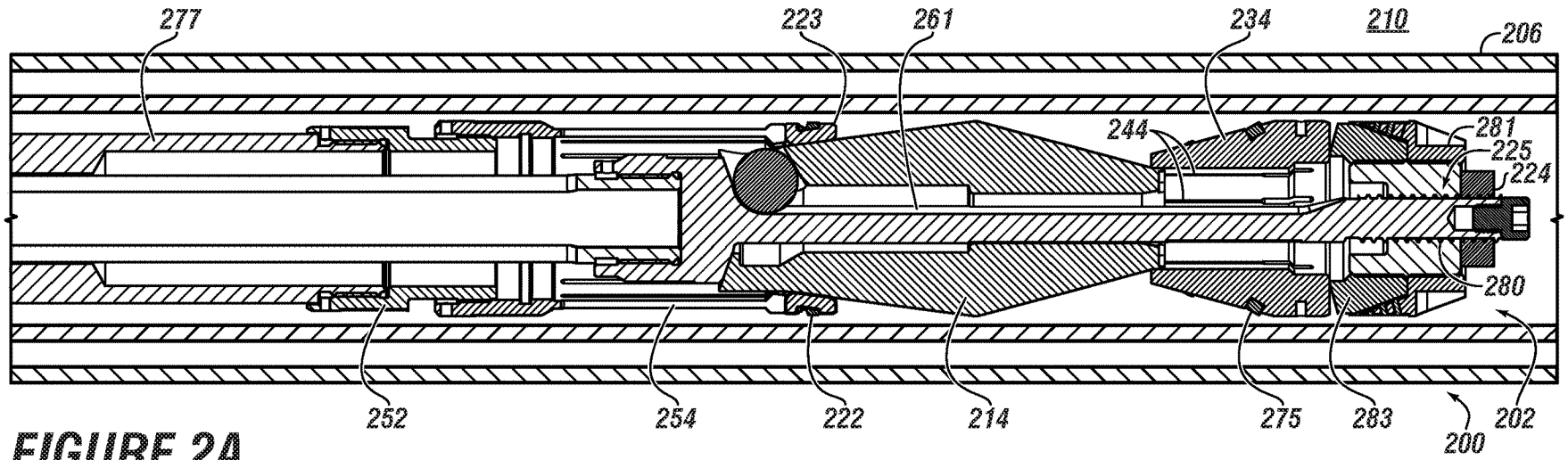
FIG. 2A shows a longitudinal side cross-sectional view of a system having a downhole tool, according to embodiments of the disclosure.
Figure 2B:
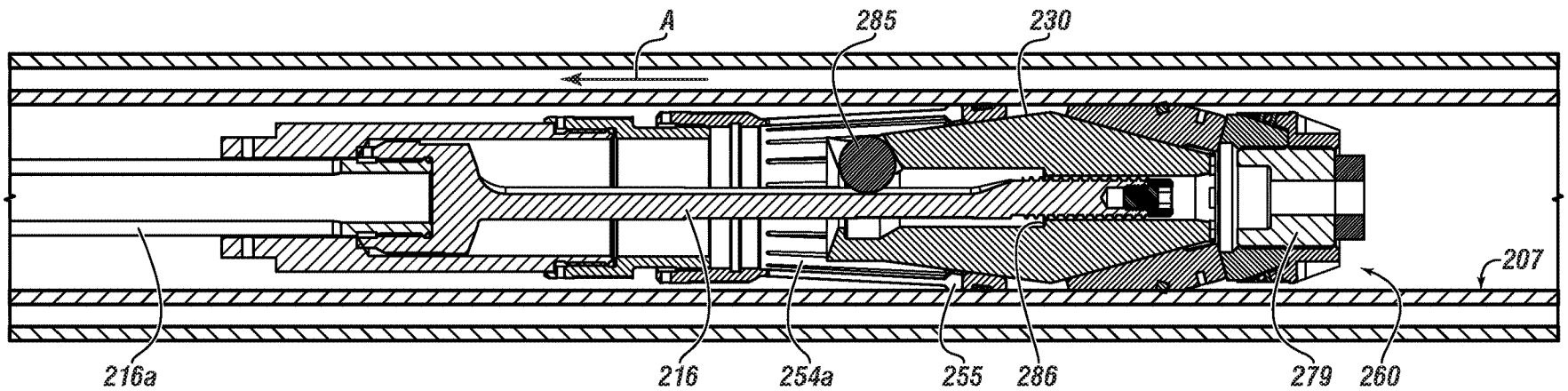
FIG. 2B shows a longitudinal side cross-sectional view of the system of FIG. 2A having a set downhole tool, according to embodiments of the disclosure.
Figure 2C:
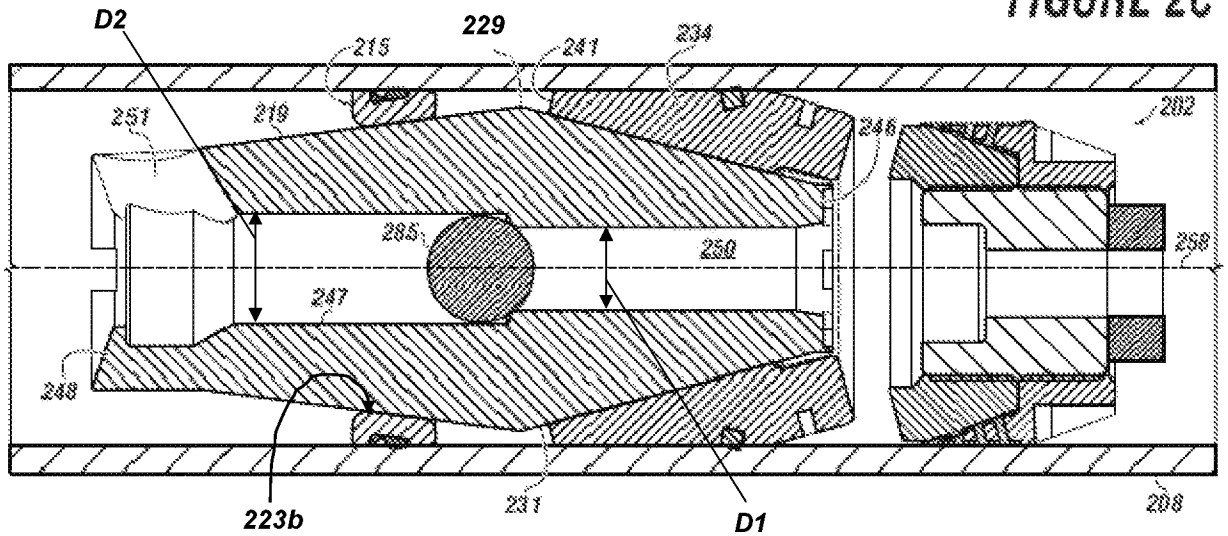
FIG. 2C shows a longitudinal side cross-sectional view of the system of FIG. 2A having a downhole tool in a disconnected set position, according to embodiments of the disclosure.

Referring now to FIGS. 2A, 2B, and 2C together, a longitudinal side views of a system 200 having a downhole tool 202 in a RIH position connected with a setting tool, a set position connected with a setting tool, and a disconnected set position, respectively, illustrative of embodiments disclosed herein, are shown. FIGS. 2A-2C together depicts a wellbore 206 formed in a subterranean formation 210 with a tubular 208 (e.g., casing, hung casing, casing string, etc.) disposed therein.

A workstring (not shown in detail here) (which may include a setting tool [or a part 217 of a setting tool]) may be used to position or run the downhole tool 202 into and through the wellbore 206 to a desired location. The setting tool may include a tension mandrel 216 associated (e.g., coupled) with an upper mandrel 216*a*. Although not shown here, the setting tool may include an adapter. In an embodiment, the adapter may be coupled with the setting tool (or part thereof) 217, and the tension mandrel 216 may be coupled with the adapter. The tension mandrel 216 may extend through, and at least partially, out of the (bottom/downhole/distal end) tool 202.

An end or extension 216*b* of the tension mandrel 216 may be coupled with a nose sleeve or nut 224. The nut 224 may have a threaded connection 225 with the end 216*b* (and thus corresponding mating threads), although other forms of coupling may be possible. Standard threading may be used, such as buttress. In embodiments, the threads may be shear threads. Either the nut 224 and/or the end 216*b* may have shear threads.

The setting tool assembly 217 may include or be associated with a setting sleeve 254. The setting sleeve 254 may be engaged with the downhole tool (or a component thereof, such as adapter 252) 202. The setting sleeve 254 may be a rigid sleeve or may be flexible via one or more collets or dogs 254*a*. The setting sleeve 254 may be coupled with an upper setting sleeve, or sometimes barrel piston 277. The barrel piston 277 may be releasably engaged with the upper mandrel 216*a*. Upon release the barrel piston 277 may be moving (e.g., slidingly) engaged with the upper mandrel 216.

Other components of the setting tool 217 not viewable here operate in a manner whereby the tension mandrel 216 may be pulled and/or at the same time the setting sleeve 254 pushes (urges), or at least holds in place, the carrier ring 223. The setting device(s) and components of the downhole tool 202 may be coupled with, and axially and/or longitudinally movable, at least partially, with respect to each other.

The downhole tool 202, as well as its components, may be annular in nature, and thus centrally disposed or arranged with respect to a longitudinal axis 258. In accordance with embodiments of the disclosure, the tool 202 may be configured as a plugging tool, which may be set within the tubular 208 in such a manner that the tool 202 forms a fluid-tight seal against the inner surface 207 of the tubular 208. The seal may be facilitated by a seal element 222 expanded into a sealing position against the inner surface 207. The seal element 222 may be supported by a carrier ring 223. The carrier ring 223 may be disposed around a double cone 214. Once set, the downhole tool 202 may be held in place by use of an at least one slip 234. The slip 234 may have a one-piece configuration. Just the same, the carrier ring 223 may not need a sealing element to seal against the inner surface 207, as the ring 223 may be comprised of a material that would allow or otherwise form a seal on its own.

In embodiments, the downhole tool 202 may be configured as a frac plug, where flow into one section of the wellbore 206 may be blocked and otherwise diverted into the surrounding formation or reservoir 210 (such as via perforations made in the tubular 208). In yet other embodiments, the downhole tool 202 may also be configured as a ball drop tool. In this aspect, a ball (e.g., 285) may be dropped into the wellbore 206 and flowed into the tool 202 and come to rest in a corresponding ball seat 286 of the double cone 214. The seating of the ball 286 may provide a seal within the tool 202 resulting in a plugged condition, whereby a pressure differential across the tool 202 may result. The ball 285 and ball seat 286 may be comparable to or analogous (or even identical) to other ball/seat embodiments described herein. The ball seat 286 may be defined by inner bore 250 having a first inner diameter D1 smaller than a second inner diameter D2, as shown in FIG. 2C.

In other embodiments, the downhole tool 202 may be a 'ball-in-place' plug, whereby the tool 202 may be configured with the ball 285 already in place when the tool 202 deploys into the wellbore 206. For example, FIGS. 2A and 2B show the ball 285 may be held in situ within a ball cavity 251 formed in the double cone 214. As the tool 202 is set, the tension mandrel 216 may eventually separate and move out of the way so that the ball 285 may be free to move to the seat 286. The ball 285 may move along a ball track 261 as the tension mandrel 216 is pulled from the tool 202.

The tool 202 may act as a check valve, and provide one-way flow capability. Fluid may be directed from the wellbore 206 to the formation 210 with any of these configurations, and vice versa.

Once the tool 202 reaches the set position within the tubular, the setting mechanism or workstring (e.g., 217) may be detached from the tool 202 by various methods, resulting in the tool 202 left in the surrounding tubular 208 and one or more sections of the wellbore 206 isolated. In an embodiment, once the tool 202 is set, tension may be applied to the setting tool 217 until a shearable connection between the tool 202 and the workstring may be broken. However, the downhole tool 202 may have other forms of disconnect. The amount of load applied to the setting tool and the shearable connection may be in the range of about, for example, 20,000 to 55,000 pounds force.

In embodiments the tension mandrel 216 may separate or detach from a lower sleeve or guide assembly 260 (directly or indirectly)), resulting in the workstring being able to separate from the tool 202, which may be at a predetermined moment. The loads provided herein are non-limiting and are merely exemplary. The setting force may be determined by specifically designing the interacting surfaces of the tool 202 and the respective tool surface angles. The tool 202 may also be configured with a predetermined failure point (not shown) configured to fail, break, or otherwise induce fracture.

Operation of the downhole tool 202 may allow for fast run in of the tool 202 to isolate one or more sections of the wellbore 206, as well as quick and simple drill-through or dissolution to destroy or remove the tool 202.

In some embodiments, drill-through may be completely unnecessary. As such the downhole tool 202 may have one or more components made of a reactive material, such as a metal or metal alloys. The downhole tool 202 may have one or more components made of a reactive material (e.g., dissolvable, degradable, etc.), which may be composite- or metal-based. In embodiments, all of the primary components of the downhole tool 202 may be composite-based material, and thus eliminate the presence of a metal component, such as a metal slip.

It follows then that one or more components of a tool of embodiments disclosed herein may be made of reactive materials (e.g., materials suitable for and are known to dissolve, degrade, etc. in downhole environments [including extreme pressure, temperature, fluid properties, etc.] after a brief or limited period of time (predetermined or otherwise) as may be desired). In an embodiment, a component made of a reactive material may begin to react within about 3 to about 48 hours after setting of the downhole tool 202.

In embodiments, one or more components may be made of a metallic material, such as an aluminum-based or magnesium-based material. The metallic material may be reactive, such as dissolvable, which is to say under certain conditions the respective component(s) may begin to dissolve, and thus alleviating the need for drill thru. These conditions may be anticipated and thus predetermined. In embodiments, the components of the tool 202 may be made of dissolvable aluminum-, magnesium-, or aluminum-magnesium-based (or alloy, complex, etc.) material, such as that provided by Nanjing Highsur Composite Materials Technology Co. LTD or Terves, Inc.

One or more components of tool 202 may be made of non-dissolvable materials (e.g., materials suitable for and are known to withstand downhole environments [including extreme pressure, temperature, fluid properties, etc.] for an extended period of time (predetermined or otherwise) as may be desired), such as steel.

The downhole tool 202 (and other tool embodiments disclosed herein) and/or one or more of its components may be 3D-printed or made with other forms of additive manufacturing.

The downhole tool 202 may include the double cone 214 that extends through for forms the main support for the tool 202 (or tool body). The double cone 214 may be a solid body. In other aspects, the double cone 214 may include a flowpath or bore 250 formed therein (e.g., an axial bore). The bore 250 may extend partially or for a short distance through the double cone 214. Alternatively, the bore 250 may extend through the entire double cone 214, with an opening at its proximate end 248 and oppositely at its distal end 246 (near downhole end of the tool 202).

The presence of the bore 250 or other flowpath through the double cone 214 may indirectly be dictated by operating conditions. That is, in most instances the tool 202 may be large enough in diameter (e.g., 4¾ inches) that the bore 250 may be correspondingly large enough (e.g., 1¼ inches) so that debris and junk may pass or flow through the bore 250 without plugging concerns.

With the presence of the bore 250, the double cone 214 may have an inner bore surface 247, which may be smooth and annular in nature. In cross-section, the bore surface 247 may be planar. In embodiments, the bore surface 247 (in cross-section) may be parallel to a (central) tool axis 258. An outer cone surface 219 may have one or more surfaces (in cross-section) offset or angled to the tool axis 258.

The bore 250 (and thus the tool 202) may be configured for part of the setting tool assembly 217 to fit therein, such as the tension mandrel 216. Thus, the tension mandrel 216, which may be contemplated as being part of the setting tool assembly 217, may be configured for the downhole tool 202 (or components thereof) to be disposed therearound (such as during run-in).

As shown, the tool 202 (such as via a lower guide (or just 'guide') assembly 260) may be configured with a shear point, such as the shear thread connection 280. The shear thread connection 280 may include shear threads formed in the guide assembly coupled with standard threads formed on the tension mandrel 216 (such as shown on end 216*b*). The guide assembly 260 may be a multi-component assembly. In embodiments, the guide assembly 260 may include one or more of a guide insert 279, a composite member 281, and a cone support 283. Although the guide assembly 260 may be coupled with and be part of the tool 202 during run-in and prior to setting, the guide assembly 260 may be free to fall away when the tool 202 is in the set position.

The set position of the tool 202 (see FIG. 2C) may include the seal element 222 and/or slip 234 engaged with the tubular 208. In an embodiment, the setting sleeve 254 (that may be configured as part of the setting tool assembly) may be utilized to force or urge (directly or indirectly) expansion of the seal element 222 into sealing engagement with the surrounding tubular 208.

When the setting sequence begins, the guide assembly 260 may be pulled via tension mandrel 216 while the setting sleeve 254 remains stationary. As the tension mandrel 216 is pulled in the direction of Arrow A, one or more of the components disposed about cone 214 between the distal end 246 and the proximate end 248 may begin to compress against one another as a result of the setting sleeve 254 (or end 255) held in place against carrier ring end surface 215. This force and resultant movement may urge the carrier ring 223 to compressively slide against an upper cone surface 230 of the double cone 214, and ultimately expand (along with the seal element 222). Thus, the carrier ring 223 may be slidingly engaged with the double cone 214. The carrier ring 223 may be slidingly, sealingly engaged with the double cone 214, such as via the use of one or more o-rings (not shown here). As shown here, in the set or unset position, an underside surface 223*b* of the carrier ring 223 may be entirely engaged with the outer surface 219. In the set position, the carrier ring 223 may be only in contact with the cone 214, and no other component of the downhole tool 202 (not including the optional seal element 222).

One of skill would appreciate that the carrier ring 223 may be made material suitable to achieve an amount of elongation necessary so that the seal element 222 disposed within the ring 223 may sealingly engage against the tubular 208. For example, the carrier ring 223 may be made out of PEEK or comparable. The amount of elongation may be in an elongation range of about 5% to about 25%—without fracture—as compared to an original size of the ring 223.

As the guide assembly 260 is pulled further in the direction of Arrow A, the guide assembly 260 (being engaged with the slip 234) may urge the slip 234 to compressively slide against a bottom cone surface 231 of the double cone 214. As it is desirous for the slip 231 to fracture, the slip 234 need not have any elongation of significance. As fracture occurs, the slip (or segments thereof) 234 may also move radially outward into engagement with the surrounding tubular 208.

The slip 234 may have gripping elements, such as wickers, buttons, inserts or the like. In embodiments, the gripping elements may be serrated outer surfaces or teeth of the slip(s) may be configured such that the surfaces prevent the respective slip (or tool) from moving (e.g., axially or longitudinally) within the surrounding tubular 208, whereas otherwise the tool 202 may inadvertently release or move from its position.

From the drawings it would be apparent that the seal element 222 (or carrier ring 223) need not be in contact with the slip 234. There may be a cone ridge 229, which may further prevent such contact between the slip 234 and the seal element 222. The Figures further illustrate that the slip 234 may be proximate to the first or distal end 246 of the double cone 214, whereas the seal element 222 may be proximate to the second or proximate end 248 of the double cone 214.

Because the sleeve 254 may be held rigidly in place, the sleeve 254 may engage against load bearing end 215 of the carrier ring 223 that may result in at least partial transfer of load through the rest of the tool 202. The setting sleeve end 255 may abut against the end 215. However, ring 223 will be urged against the double cone 214, as mandrel 216 is pulled.

The same effect, albeit in opposite direction may be felt by the slip 234. That is, the double cone 214 may eventually reach a (near) stopping point, and the easiest degree of movement (and path of least resistance) is the slip 234 being urged by the guide assembly 260 against the bottom cone surface 231. As a result, the slip 234 (or its segments) may urge outward and into engagement with the surrounding tubular 208.

In the event inserts 275 are used, one or more may have an edge or corner suitable to provide additional bite into the tubular surface. In an embodiment, any of the inserts may be mild steel, such as 1018 heat treated steel, or other materials such as ceramic.

In an embodiment, slip 234 may be a one-piece slip, whereby the slip 234 has at least partial connectivity across its entire circumference. Meaning, while the slip 234 itself may have one or more grooves (or undulation, notch, etc.) configured therein, the slip 234 itself has no initial circumferential separation point. In an embodiment, the grooves of the slip may be equidistantly spaced or disposed therein.

The downhole tool 202 may have a pumpdown ring or other suitable structure to facilitate or enhance run-in. The downhole tool 202 may have a 'composite member' 281 as described herein. As shown here, the composite member 281 may part of the guide assembly 260.

Although not shown here, the tool 202 may include an anti-rotation assembly comparable to that described herein in other embodiments.

Of great significance, the downhole tool 202 may have an assembled, unset length L1 of less than about 20 inches. In embodiments the downhole tool 202 may have a length L1 in a range of about 3.5 inches to about 22 inches.

The downhole tool 202 may have one or more components, such as the slip 234 and double cone 214, which may be made of a material as described herein and in accordance with embodiments of the disclosure. Such materials may include composite material, such as filament wound material, reactive material (metals or composites), and so forth. Filament wound material may provide advantages to that of other composite-type materials, and thus be desired over that of injection molded materials and the like. Other materials for the tool 202 (or any of its components) may include dissolving thermoplastics, such as PGA, PLL, and PLA.

One of skill would appreciate that in an assembled configuration and not connected with the setting tool (or part of 217), one or more components of the tool 202 may be susceptible to falling free from the tool. As such, one or more components may be bonded (such as with a glue) to another in order to give the tool 202 an ability to hold together without the presence of the setting tool. Any such bond need not be of any great strength. In embodiments, the components of the tool 202 may be snugly press fit together.

The double cone 214 may have the first outer cone surface 230 and the second outer cone surface 231 that may be generally planar. Thus, the first outer cone surface 230 and the second outer cone surface 231 may have respective reference planes P1, P2. The planes P1, P2 (and the outer surfaces 230, 231) may be offset from a long axis 258 of the tool 202 (or respective longitudinal axis or reference planes) by an angle a1 and a2 respectively. That is, the plane P1 may bisect the long axis 258 at the angle a1, and the plane P2 may bisect the long axis 258. The angles a1 and a2 may be equal and opposite to another. For example, the second angle a2 may be negative to the first angle a1 (e.g., +10 degrees for the first, −10 degrees for the second), and thus providing the 'dual' cone shape of the cone 214.

In embodiments, the angle of a1 and/or a2 may be in an angle range of about 5 degrees to about 10 degrees. Angles of the double cone surface(s) described herein may be negative to that of others, with one of skill understanding a positive or negative angle is not of consequence, and instead is only based on a reference point. An angle may be an 'absolute' angle is meant refer to angles in the same magnitude of degree, and not necessarily of direction or orientation.

In embodiments, the angles a1 and a2 may be substantially equal (albeit opposite) to each other in the assembled or run-in configuration. Thus, each of the angles a1 and a2 may be in the range of about 5 degrees to about 10 degrees with respect to a reference axis. At the same time a1 and a2 may be equal to each other in magnitude (within a tolerance of less than 0.5 degrees) at about 7.5 degrees. The angles a1 and a2 may be in a range of 5 degrees to 40 degrees, and may differ from each other. For example, a1 may be about 8 degrees, and a2 may be −20 degrees.

Where the surfaces 230, 231 converge, there may be the crest 229. The crest 229 may be an outermost, central point of the double cone 214. Thus, a wall thickness Tw may be at its widest (thickest) point at the crest 229. Notably the wall thickness may be at its least point at the respective ends 246, 248. As such, the wall thickness Tw at the crest 229 may be greater than either or both of the wall thickness Tw at the ends 246, 248. The crest 229 may beneficially limit any chance of undesirable extrusion.

The seal element 222 may be made of an elastomeric and/or poly material, such as rubber, nitrile rubber, Viton or polyeurethane. In an embodiment, the seal element 222 may be made from 75 to 80 Duro A elastomer material.

The seal element 222 may be configured to expand and elongate a radial manner, into sealing engagement with the surrounding tubular 208 upon compression of the tool components. Accordingly, the seal element 222 may provide a fluid-tight seal of the seal surface against the tubular. The seal element 222 may be disposed within a circular carrier ring groove 223*a*. The seal element 222 may be molded or bonded into the groove 223*a*.

The slip 234 may include one or more grooves 244. In an embodiment, the grooves 244 may be equidistantly spaced or cut in the slip 234. In other embodiments, the grooves 244 may have an alternatingly arranged configuration (not shown here). One or more grooves 244 may extend all the way through the slip end 241, such that slip end 241 may be devoid of material at a point between the slip fingers.

The arrangement or position of the grooves 244 of the slip 234 may be designed and configured in an analogous or comparable manner to other embodiments described herein.

The slip 234 may be coupled or engaged, or proximately positioned, with the guide assembly 260. Coupling may be via glue or other adhesive, or other form of mechanical connection.

Figure 3B:
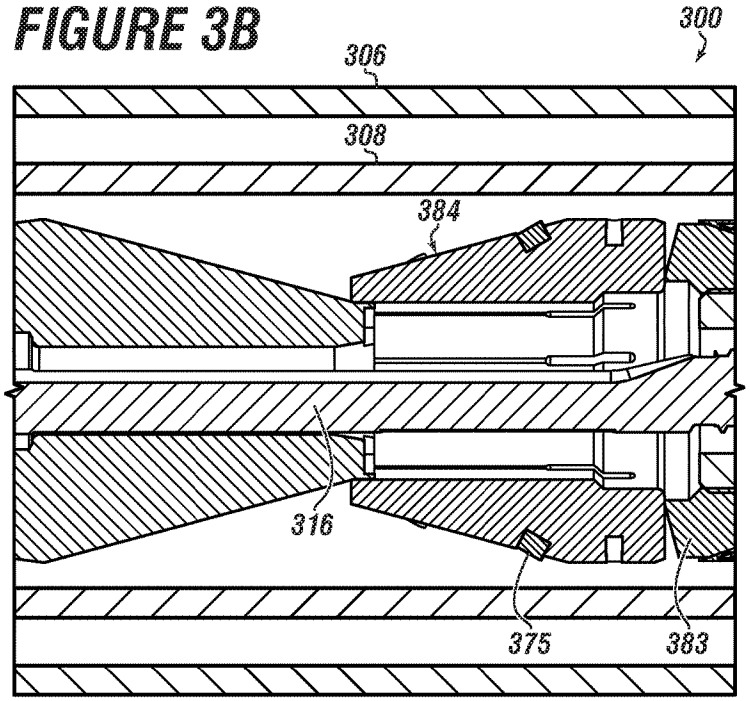
FIG. 3B shows a partial longitudinal cross-sectional side view of the downhole tool of FIG. 3A in a wellbore, according to embodiments of the disclosure.
Figure 3A:
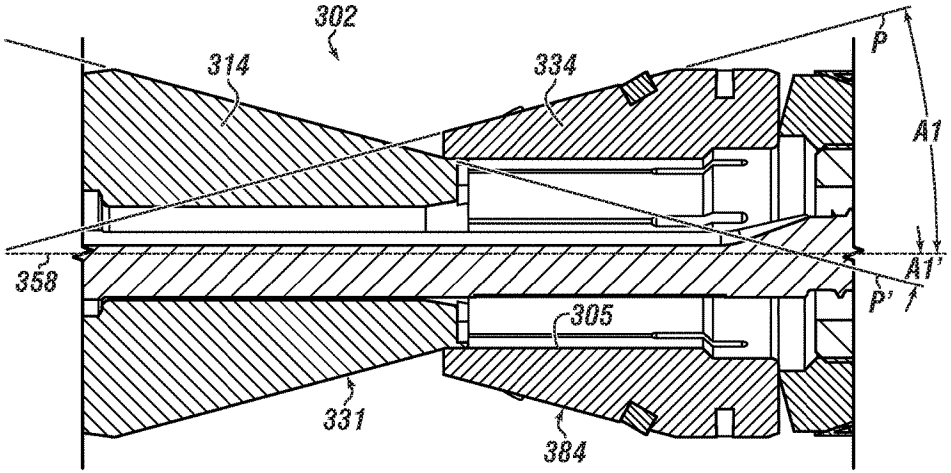
FIG. 3A shows a partial longitudinal cross-sectional side view of a downhole tool, according to embodiments of the disclosure.
Figure 3C:
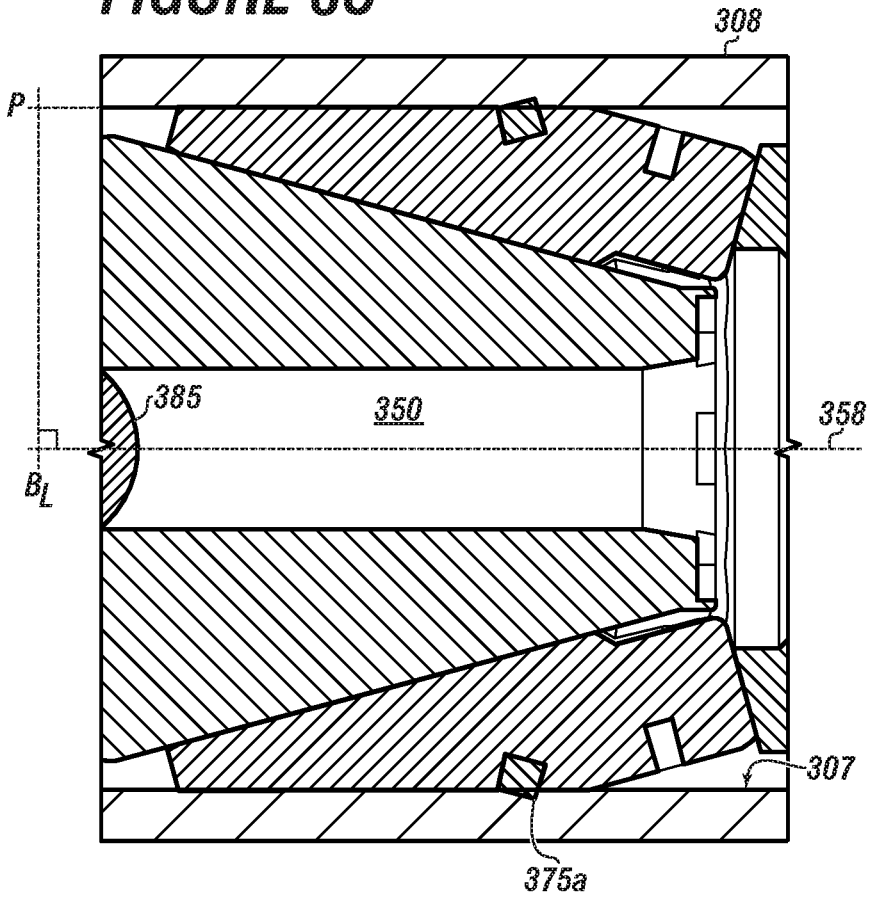
FIG. 3C shows a partial longitudinal cross-sectional side view of the downhole tool of FIG. 3B set in the wellbore, according to embodiments of the disclosure.

Referring now to FIGS. 3A, 3B, and 3C together, a partial longitudinal cross-sectional side view of a downhole tool, a partial longitudinal cross-sectional side view of an unset downhole tool in a wellbore, and a partial longitudinal cross-sectional side view of a set downhole tool, respectively, of the downhole tool with a bottom one-piece slip, in accordance with embodiments disclosed herein, are shown.

The downhole tool 302 may be run, set, and operated as described herein and in other embodiments (such as in System 200, and so forth), and as otherwise understood to one of skill in the art. Components of the downhole tool 302 may be arranged and disposed about a cone 314, as described herein and in other embodiments, and as otherwise understood to one of skill in the art. Thus, downhole tool 302 may be comparable or identical in aspects, function, operation, components, etc. as that of other tool embodiments disclosed herein. Similarities may not be discussed for the sake of brevity.

Operation of the downhole tool 302 may allow for fast run in of the tool 302 to isolate one or more sections of a wellbore as provided for herein. Drill-through of the tool 302 may be facilitated by one or more components and sub-components of tool 302 made of drillable material that may be measurably quicker to drill through than those found in conventional plugs, and/or made of reactive materials that may make drilling easier, or even outright alleviate any need.

The downhole tool 302 may have one or more components, such as slip 334, which may be made of a material as described herein and in accordance with embodiments of the disclosure. Such materials may include composite material, such as filament wound material, reactive material (metals or composites), and so forth. Filament wound material may provide advantages to that of other composite-type materials, and thus be desired over that of injection molded materials and the like.

The slip 334 may be associated with, and thus proximate to, a respective cone or conical member 383. In embodiments, a composite or deformable member (e.g., 281) may be used instead of or in association with the support cone 383. Although only shown in part here, the support cone 383 may be part of a guide assembly (e.g., 260)

The double cone 314 may extend through the tool (or tool body) 302 in the sense that components may be disposed therearound. The double cone 314 may be a solid body. In other aspects, the double cone 314 may include a flowpath or bore 350 formed therein (e.g., an axial bore). The bore 350 may extend partially or for a short distance through the cone 314. Alternatively, the bore 350 may extend through the entire cone 314.

With the presence of the bore 350, the cone 314 may have at least a portion of a setting tool disposed therein (e.g., 217). As shown here in part, a tension mandrel 316 (as part of a setting tool assembly) may be disposed within the cone 314.

To facilitate embodiments herein that may beneficially desire a 'bottom' or 'first' slip 334 be non-metallic, and particularly filament wound composite material. The slip 334 may include an angled outer surface 384. The outer surface 384 may be respective to one or more respective slip segments associated therewith, and/or more generally the entire effective outer surface. FIG. 3A illustrates in cross-section the outer surface 384 being defined with a plane P (shown in 2D as a line) being parallel thereto. One of skill may appreciate the plane P being tangent to one or more point on the outer surface 384.

Any slip segment or finger of the slip 334 may have a respective outer surface 384 with related plane P in cross-section. The plane P may bisect a longitudinal axis 358 of the downhole tool 302 at an angle a1. The angle a1 may be greater than one degree. In embodiments the angle a1 may be in the range of 10 degrees to 20 degrees.

It is within the scope of the disclosure that although shown or contemplated as a one-piece slip, other embodiments remain possible, such as a multi-segmented slip (which may be held together by a band or ring), and thus not one-piece.

The downhole tool 302 may be run into wellbore 306 (such as within tubular 308) to a desired depth or position by way of a workstring that may be configured with the setting device or mechanism, and thus part of an overall system 300. The system 300 may comparable in nature to those described herein.

The setting device(s) and components of the downhole tool 302 may be coupled with, and axially and/or longitudinally movable along dual cone 314. When the setting sequence begins, the tension mandrel 316 may be pulled into tension while the setting sleeve remains stationary. The support cone 383 (or guide assembly) may be pulled as well because of its attachment to the tension mandrel 316 by virtue of the coupling of threads or the like (which may be with a component not viewable here, such as a guide insert [279]).

As the cone 383 is pulled, the components disposed about the dual cone 314 between the cone 383 and the setting sleeve (e.g., 254) may begin to compress against one another. As the cone is pulled further in tension, the cone 383 may compresses against the slip 334. As a result, slip 334 may move along a tapered or angled surface 331 of cone 314, and eventually radially outward into engagement with the surrounding tubular 308 (as shown in FIG. 3C).

The slip 334 may be configured with varied gripping elements (e.g., buttons or inserts 375) that may aid or prevent the slips (or tool) from moving (e.g., axially or longitudinally) within the surrounding tubular, whereas otherwise the tool 302 may inadvertently release or move from its position. Of distinction as compared to other slips, the slip 334 may be made of filament wound composite material. Non-wound composite slips, such as molded slips, would not have inner layers/layer interfaces, so one of skill would appreciate that not all composite materials are the same—each provides its own set of advantages, disadvantages, traits, physical properties, etc.

The inserts 375 may have an edge or corner 375*a* suitable to provide additional bite into the tubular surface 307. In an embodiment, the inserts 375 may be mild steel, such as 1018 heat treated steel. The use of mild steel may result in reduced or eliminated casing damage from slip engagement and reduced drill string and equipment damage from abrasion. The inserts may be non-metallic, such as ceramic or comparable. The insert 375 may have a central hollow (partial or full) all the way through its body. A partial hollow may be akin to a depression.

It has been discovered that a large coefficient of friction may exist between the cone surface 330 and the slip underside 305. At the microscopic level, millions of fibers may undesirably interact with each other akin to the way Velcro hook-and-loop sticks, causing an undesired sticking between the surfaces, which may further result in failure of the tool 302 to set. Although not shown here, one or more surfaces 330 and/or 305 may be surface coated to reduce the coefficient of friction therebetween. The surface coating may be sprayed, cooked, cured, etc. onto surfaces 330, 305.

The surface coating may be a ceramic, a sulfide, teflon, a carbon (e.g., graphite), etc. The surfaces 330, 305 may be further lubricated, such as with a grease- or oil-based material.

Accordingly, the slip 334 may be urged radially outward and into engagement with the tubular 308.

As FIGS. 3A and 3B illustrate (prior to setting) in longitudinal cross-section how the outer slip surface 384 may be generally planar. Thus, the outer surface 384 may have the plane P. The plane P (and the outer surface 384) may be offset from a long axis 358 of the tool 302 (or respective longitudinal axis or reference plane of the proximate surrounding tubular 308) by an angle a1. That is, the plane P may bisect the long axis 358 at the angle a1. Alternatively, or additionally the plane P may bisect the reference plane of a tubular sidewall at the same angle a1.

One of skill may appreciate the tubular 308 need not have an inner wall 307 that is precisely axially linear through its entire length. However, in the proximity to where the downhole tool 302 is set, and merely for reference frame purposes, the tubular 308 may generally have the tubular sidewall that may effectively have the planar reference plane tantamount to parallel to axis 358 in proximity to the tool 302. In this respect to the angle a1 with reference to either bisect point would be equal by way of congruency.

In embodiments, the angle of a1 may be in an angle range of about 1 degree to about 20 degrees. In embodiments the angle range of a1 may be between about 10 degrees to about 20 degrees. The angle a1 may be about 10 degrees to about 15 degrees. FIG. 3C illustrates (post-setting) the plane P of outer slip planar surface 384 (as shown in cross-section) may now be generally parallel to the long axis 358. In this respect, the body of slip 334 may have a pivot movement associated with it beyond that of generally radially outward. 'Parallel' is meant to include a tolerance of less than 1 degree. Parallel may further to include a bisect line $B_L$ being perpendicular (with reasonable tolerance) to that of the reference plane 358, plane P (when slip is set), and axis 358. In the set position, 'parallel' may be emblematic of (at least most of) surface 384 being moved into proximate engagement the tubular 308.

The angle of offset (e.g., with reference to plane P versus axis 358 after setting) may be limited by various parameters, including lateral thickness of the slip, the mandrel OD, as well as tool OD. For example, a large offset angle may be desired, but this may require the OD of the slip to be larger than the OD of the tool, which renders the tool susceptible to presetting and other failure modes.

In an analogous manner the Figures illustrate in longitudinal cross-section how the outer cone surface 330 may also be generally planar. Thus, the outer cone surface 330 may have an associated plane P'. The plane P' (and the outer surface 330) may be offset from a long axis 358 of the tool 302 (or respective longitudinal axis or reference plane of the proximate surrounding tubular 308) by an angle a1'. That is, the plane P' may bisect the long axis 358 at the angle a1'. Alternatively, or additionally the plane P' may be bisect a reference plane of a tubular sidewall 307 at the same angle a1'.

In embodiments, the angle of a1' may be in an angle range of about 1 degree to about 20 degrees. In embodiments the angle range of a1' may be between about 5 degrees to about 15 degrees. In other embodiments, the range of a1' may be between about 10 degrees to about 20 degrees.

Angles described herein may be negative to that of others as the tool 302 is assembled, with one of skill understanding a positive or negative angle is not of consequence, and instead is only based on a reference point. 'Absolute' angle is meant refer to angles in the same magnitude of degree, and not necessarily of direction or orientation.

In embodiments, the angles a1 and a1' are substantially equal to each other in the assembled or run-in configuration. Thus, each of the angles a1 and a1' may be in the range of about 10 degrees to about 20 degrees absolute with respect to a reference axis. At the same time a1 and a1' may be equal to each other (within a tolerance of less than 0.5 degrees).

One of skill would appreciate that upon setting, the angle of offset may also be equal to that of a1', whereas the angle a1 moves to zero.

Figure 4A:
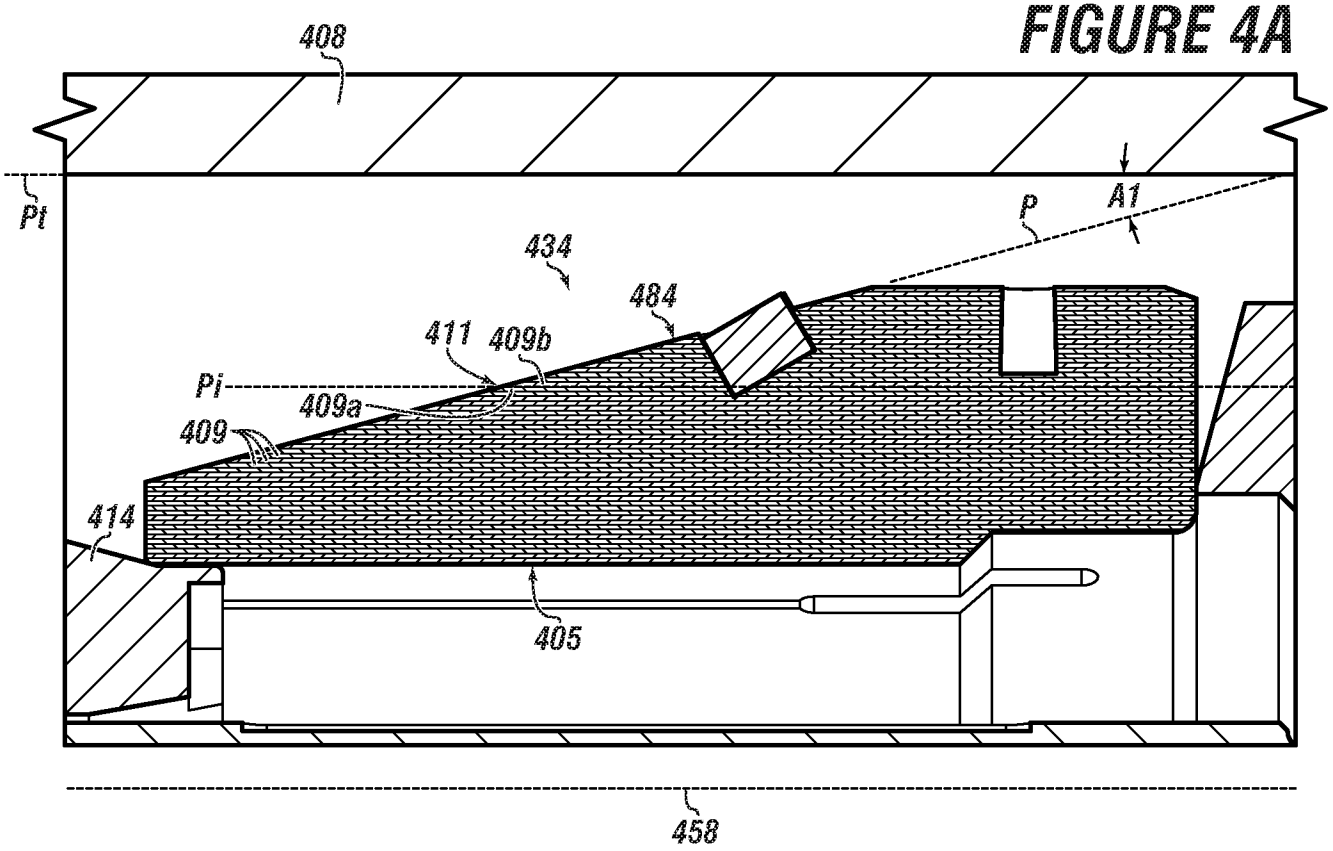
FIG. 4A shows a close-up longitudinal side cross-sectional view of a one-piece slip disposed proximate a cone in a run-in position, according to embodiments of the disclosure.
Figure 4B:
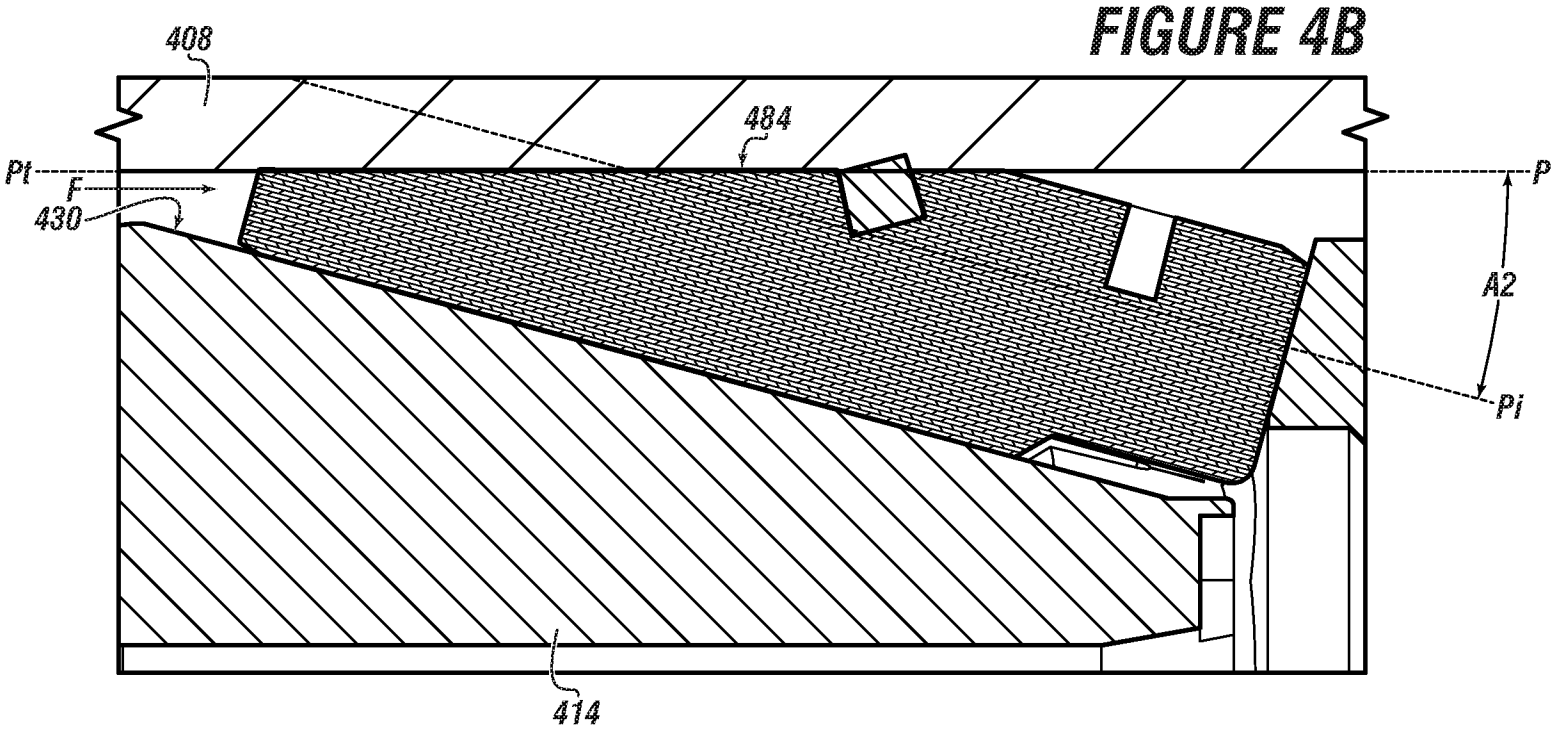
FIG. 4B shows a close-up longitudinal side cross-sectional view of the slip of FIG. 4A moved to a set position, according to embodiments of the disclosure.

Referring briefly to FIGS. 4A and 4B, a close-up longitudinal side cross-sectional view of a one-piece slip disposed proximate a cone in a run-in position, and a close-up longitudinal side cross-sectional view of the slip of FIG. 4A moved to a set position, respectively, in accordance with embodiments disclosed herein, are shown.

Slip 434 may be like that of slip 334 (and other slips described herein), and thus usable for downhole tool (e.g., 202, 302, etc.), as well as other embodiments herein. As shown the slip 434 may have a body made of a composite material, such as filament wound material, and thus formed from a winding process that results in layering. The slip (or slip body) 434 may thus have a plurality of layers 409 of material may be bound together, such as physically, chemically, and so forth to form an article, of which the slip 434 may be machined therefrom. Adjacent layers, such as layers 409 *a, b* may have a generally planar (resin) interface 411, which may be further referenced by interface plane Pi. Once of skill would appreciate the interface 411 on the microscopic level may include interaction of fibers from adjacent layers.

FIG. 4A in particular shows the run-in or preset configuration of the slip 434 in contact with the double cone 414.

A difficulty in using a composite slip in the 'bottom' position is the ability to provide a predictable breaking point, especially as compared to a metal-material slip. However, while metal slips may provide predictability, they have the inherent detractions described herein.

Embodiments herein provide for the slip 434 to have a break point in the range of about 2000 lbs to about 5000 lbs of axial setting force. Which is to say once the break point is reached, the slip 434 may begin to set. It should be appreciated that the slip 434 may beneficially be provided with the ability to withstand a brief inadvertent force, even if the force is higher than 2000 lbs.

Once a sufficient amount of force is incurred into the tool, the underside of the slip (or respective slip segments) 405 may now move into engagement with the double cone outer surface (or respective cone face) 430 (see FIG. 4B). The amount of force to move the slip segments may be in the range of about 2000 lbs to about 5000 lbs of axial setting force during the setting sequence. In embodiments the range may be about 3500 to about 4500.

When running in the well there may be countless events that could impart a force high enough to preset the slip 434 (or 234, etc.). The resiliency of the composite material may allow the slip 434 to deform slightly under short duration impact/load then return to its original shape/position. The process which may give the greatest risk of preset is pump-down. During pump-down the speed of the fluid in the well bore and the speed of the tool string/wireline must be maintained such that the differential pressure caused by fluid flowing past the tool does not induce enough force to deploy the lower slip 434. If a lower slip on a tool deploys while the tool is moving chances are it will lock in place (pre-set) at an undesired depth. The cost of removing the plug may be $1M+. Pre-set typically happens when the wireline stops and the pumps do not. The initiation break force of the slip 434 may be predetermined to be slightly higher than the weak point at the connection between the wireline and tool string such that the wireline will release before the slip 434 sets.

As shown in FIG. 4A, as the downhole tool with slip 434 thereon is brought to rest at the position to which the tool will be set, the reference plane Pi of the interface 411 may be approximately parallel to the tool axis (e.g., 458) or to a tubular plane Pt. Also prior to setting, an outer surface 484 of the slip 434 may be defined by residing in a reference surface plane P that is offset from tubular reference plane Pt. The angle a1 of offset may be at least one degree. The angle a1 may be in the range of about 1 to about 20 degrees. The angle a1 may be about 10 degrees to about 15 degrees.

As shown in FIG. 4B, upon setting, the outer surface 484 may be substantially engaged with the surrounding tubular 408, and thus reference planes P and Pt may now be contemplated as being parallel to each other (e.g., a1 now equivalent to 0 degrees). It is noted that the vector F may be in either direction (e.g., uphole or downhole). Meanwhile angle a2 has now moved from 0 degrees to that of which a1 was in FIG. 4A. In this respect, a2 in FIG. 4B (post-setting) may be of offset may be at least one degree. The post-setting angle a2 may be in the range of about 1 to about 20 degrees. The angle a2 may be about 10 degrees to about 15 degrees.

Forces (including net or cumulative) may be represented a vector F that similarly lies in a plane $P_F$ parallel to reference planes P and P'. By congruency, these forces F may now also be offset from the resin interface layer 411 by angle a2. By way of the motion of the slip 434, pre-set angle a1 may be equal to post-set angle a2.

Figure 5B:
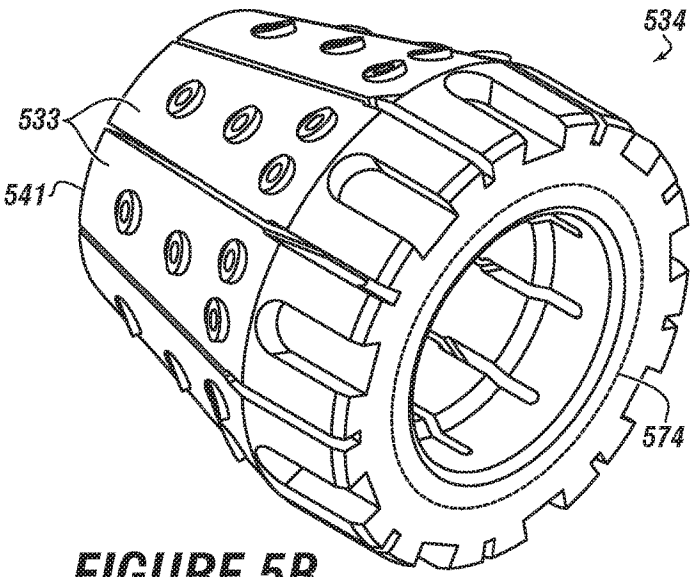
FIG. 5B shows a rear-side isometric view of the slip of FIG. 5A, according to embodiments of the disclosure.
Figure 5A:
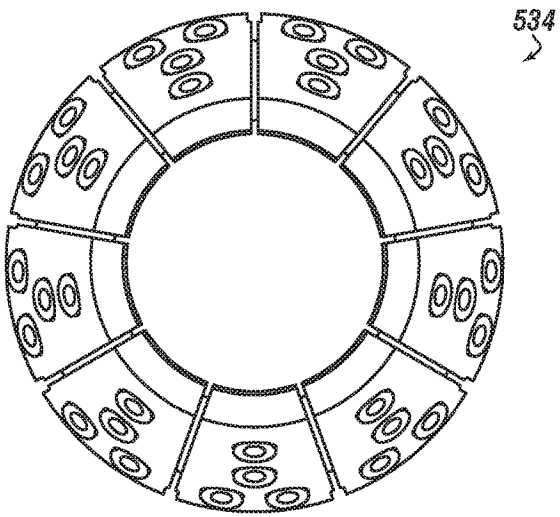
FIG. 5A shows a close-up longitudinal side cross-sectional view of a front-side thru-bore view a one-piece slip (and related subcomponents), according to embodiments of the disclosure.
Figure 5C:
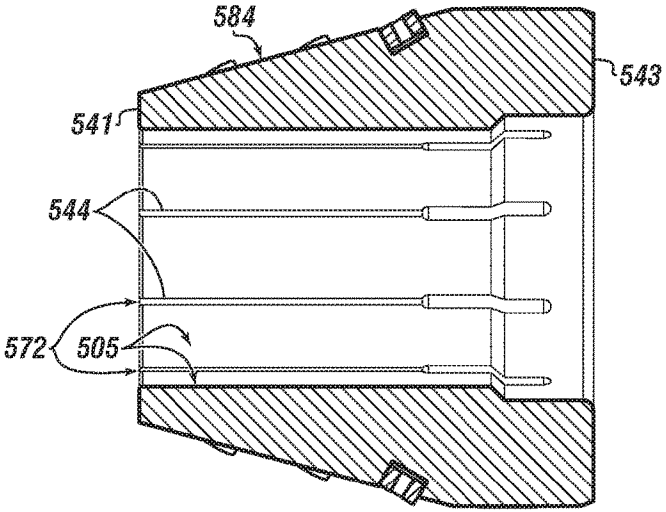
FIG. 5C shows a longitudinal side cross-sectional view of the slip of FIG. 5A, according to embodiments of the disclosure.

Referring now to FIGS. 5A, 5B, and 5C together, a front-side thru-bore view, a rear-side isometric view, and a longitudinal side cross-sectional view, of a one-piece slip (and related subcomponents), respectively, usable with a downhole tool in accordance with embodiments disclosed herein, are shown.

Slip 534 may be like that of other slips described herein, and thus usable for a downhole tool in accordance with embodiments herein. As shown the slip 534 may have a body made of a composite material. While other materials may be possible (such as a metal, metal alloys, reactive material, etc.), in embodiments the slip 534 may be made of or from a composite material, such as filament wound composite.

The slip 534 may include a plurality of slip segments 533. While not limited, the number of slip segments 533 may be about 3 to about 11 segments. In contrast to conventional segmented slips, the slip 533 may be or have a one-piece configuration. The one-piece configuration may be that which has at least partial material connectivity around the body of the slip 533. For example, material connectivity line 574 illustrates such a configuration. Material connectivity around the slip body may mean just that—the presence of material therearound. Without such a configuration, it would be necessary for some other mechanism to hold pieces/segments of the slip together.

One segment 533 may be separated from another (adjacent) segment by way of a longitudinal groove 544 (longitudinal in the sense of being referenced from one end 541 of the slip to the other end 543). The groove 544 may indeed extend from the end 541 to the other end 543, but need not go entirely through the end(s). For example, there may be an amount of slip material or region 571 sufficient for rigidly holding the slip 534 together, as well as being durable enough (in combination with other regions).

The groove 544 may also reflect a lateral opening through the slip body 534. That is, the groove 544 may have a depth that extends from an outer surface 584 to an inner surface 505. Depth may define a lateral distance or length of how far material is removed from the slip body with reference to slip surface 584 (or also inner slip surface 505). One of skill would appreciate the dimension(s) of the groove 544 at a given point may vary along the slip body.

The groove 544 may extend all the way through the slip end 541, as well as from outer surface 584 to inner surface 505, and may thus be devoid of material at point(s) 572. However, the groove 544 may not extend all the way laterally through the body at the other end 543.

Where the slip 534 is void of material at its end 541 (or segment ends), that portion or proximate area of the slip 534 may have the tendency to flare first during the setting process. The arrangement or position of the grooves 544 of the slip 534 may be designed as desired. In an embodiment, the slip 534 may be designed with grooves 544 that facilitate an equal distribution of radial load along the slip 534. The slip 534 may include or be configured with the ability to grip the inner wall of a tubular, casing, and/or well bore, such as the buttons or inserts.

Figure 6A:
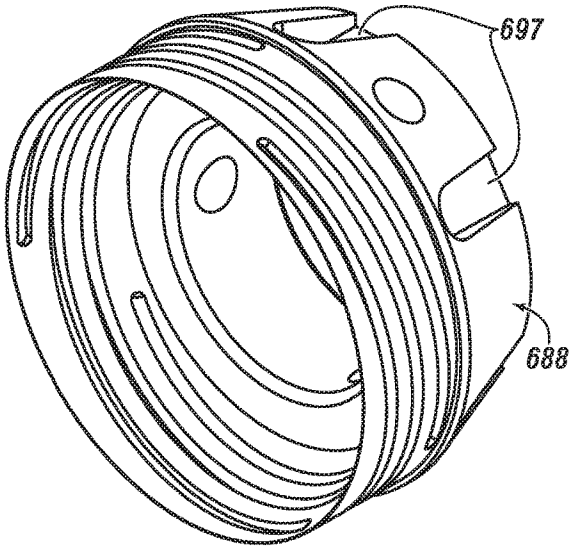
FIG. 6A shows a rear-side isometric view of a front-side thru-bore view a composite deformable member (and related subcomponents), according to embodiments of the disclosure.
Figure 6C:
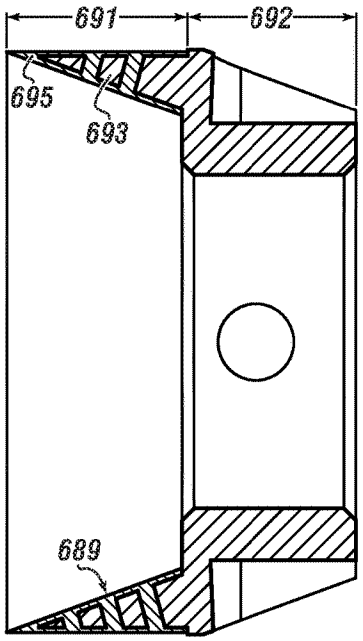
FIG. 6C shows a longitudinal side cross-sectional view of the composite member of FIG. 6A with a second material, according to embodiments of the disclosure.
Figure 6B:
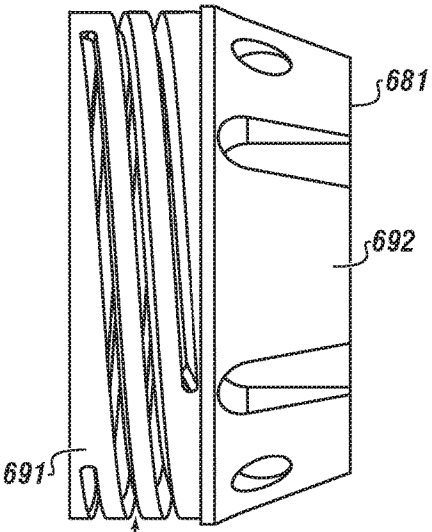
FIG. 6B shows a longitudinal side view of the composite member of FIG. 6A, according to embodiments of the disclosure.

Referring now to FIGS. 6A, 6B, and 6C together, a rear-side isometric view, a longitudinal side view, and a longitudinal cross-sectional view, respectively, of a composite deformable member 681 (and its subcomponents) usable with a downhole tool in accordance with embodiments disclosed herein, are shown. The composite member 681 may be configured in such a manner that upon a compressive force, at least a portion of the composite member may begin to deform (or expand, deflect, twist, unspring, break, unwind, etc.) in a radial direction away from the tool axis (e.g., 258). Although exemplified as "composite", it is within the scope of the disclosure that member 681 may be made from metal, including alloys and so forth.

During the setting sequence, the support cone (283) and the composite member 581 may compress together. As a result, a deformable (or first or upper) portion 691 of the composite member 681 may be urged radially outward. There may also be a resilient (or second or lower) portion 692. In an embodiment, the resilient portion 692 may be configured with greater or increased resilience to deformation as compared to the deformable portion 691.

The composite member 681 may be a composite component having at least a first material 693 and a second material 695, but composite member 681 may also be made of a single material. The first material 693 and the second material 695 need not be chemically combined. In an embodiment, the first material 693 may be physically or chemically bonded, cured, molded, etc. with the second material 695. Moreover, the second material 695 may likewise be physically or chemically bonded with the deformable portion 691. In other embodiments, the first material 693 may be a composite material, and the second material 695 may be a second composite material.

The composite member 681 may have cuts or grooves 696 formed therein. The use of grooves 696 and/or spiral (or helical) cut pattern(s) may reduce structural capability of the deformable portion 691, such that the composite member 681 may "flower" out. The groove 696 or groove pattern is not meant to be limited to any particular orientation, such that any groove 696 may have variable pitch and vary radially.

With groove(s) 696 formed in the deformable portion 691, the second material 695, may be molded or bonded to the deformable portion 691, such that the grooves 696 may be filled in and enclosed with the second material 695. In embodiments, the second material 995 may be an elastomeric material. In other embodiments, the second material 695 may be 60-95 Duro A polyurethane or silicone. Other materials may include, for example, TFE or PTFE sleeve option-heat shrink. The second material 695 of the composite member 681 may have an inner material surface 689.

The rigid portion 692 may have an outer surface 688 configured with one or more undulations or notches 697. Any notch 697 may have a 'U' shape. The notches 697 may promote better drilling in the event the composite member 681 falls away and engages another tool somewhere else in the wellbore.

Figure 7A:
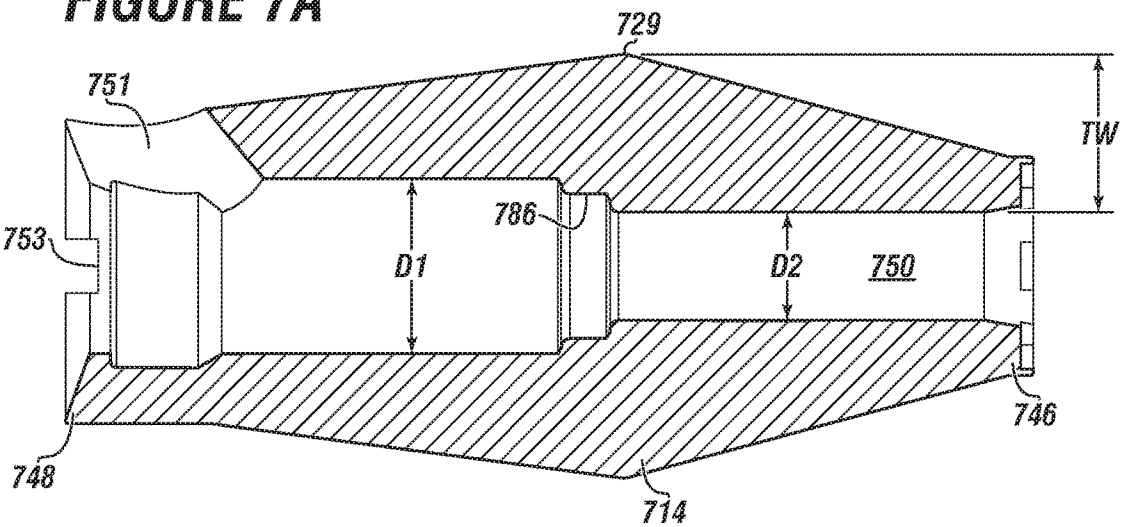
FIG. 7A shows a longitudinal side cross-sectional view of a double cone, according to embodiments of the disclosure.
Figure 7B:
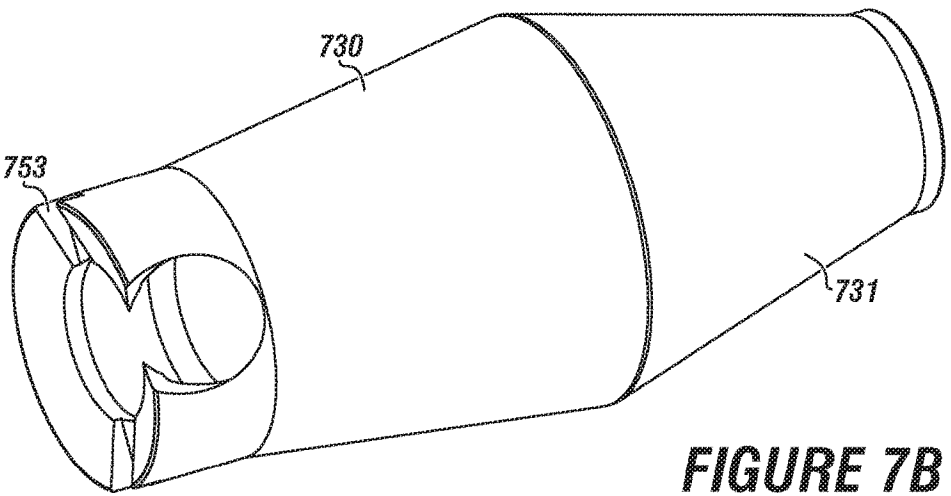
FIG. 7B shows an isometric view of the double cone of FIG. 7A, according to embodiments of the disclosure.
Figure 7C:
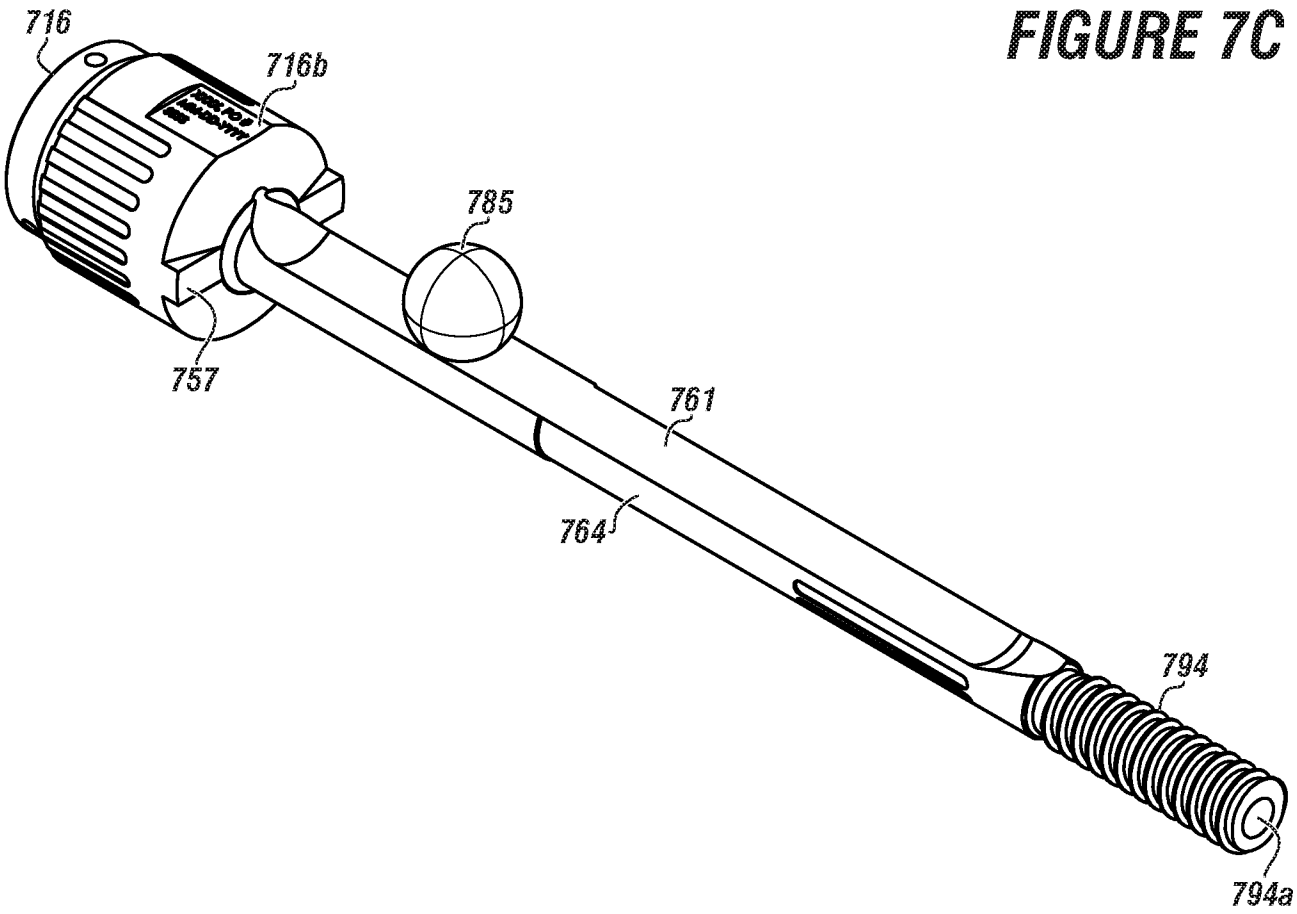
FIG. 7C shows an isometric view of a tension mandrel configured to engage the double cone of FIG. 7A, according to embodiments of the disclosure.

Referring now to FIGS. 7A, 7B, and 7C together, a longitudinal side cross-sectional view of a double cone, an isometric view of the double cone of FIG. 7A, and an isometric view of a tension mandrel configured to engage the double cone of FIG. 7A, respectively, in accordance with embodiments disclosed herein, are shown.

Components of downhole tool embodiments of the present disclosure may be arranged and disposed about a double cone 714, as described herein and in other embodiments, and as otherwise understood to one of skill in the art. The double cone 714 may be comparable or identical in aspects, function, operation, components, etc. as that of other cone embodiments disclosed herein. Similarities may not be discussed for the sake of brevity.

The double cone 714 may have one or more components disposed therearound. The cone 714 may include a flowpath or bore 750 formed therein (e.g., an axial bore), which may correspond a bore of the tool (e.g., 302). The bore 750 may extend partially or for a short distance through the double cone 714. Alternatively, the bore 750 may extend through the entire cone 714, with an opening at its proximate end 748 and oppositely at its distal end 746.

The double cone 714 may have a first outer cone surface 730 and a second outer cone surface 731, either or both of which may be generally planar. As such, the cone 714 may have the illustrated 'dual' cone shape. Where the surfaces 730, 731 converge, there may be a crest 729. The crest 729 may be an outermost, central point of the double cone 714. Thus, a wall thickness Tw may be at its widest (thickest) point at the crest 329.

The bore 750 may of varied shape. For example, an uppermost portion may have a first inner bore diameter D1, while a lowermost portion may have a second inner bore diameter D2. The first diameter D1 may be larger than the second diameter D2. In this respect, the cone 714 may have a ball seat 786 formed therein.

The bore 750 may be configured to accommodate a setting tool (or component thereof, e.g., tension mandrel 716) fitting therein. During assembly and run-in, an upper end 716*b* of the tension mandrel may be engaged with the cone 714. The upper end 716*b* may be configured with one or more keys 757, which may be configured to fit within a respective key slot 753 formed in the proximate end 748.

A shaft 764 of the tension mandrel 716 may have a groove or ball track 761 formed thereon. As such, the shaft 764 may not be cylindrical in nature, but instead accommodate the ball 785 engaged therewith while the ball 785 resides within a ball cavity 751. The ball cavity 751 may be formed in a sidewall of the double cone 714. The cavity 751 may be at the proximate end 748.

Figure 8B:
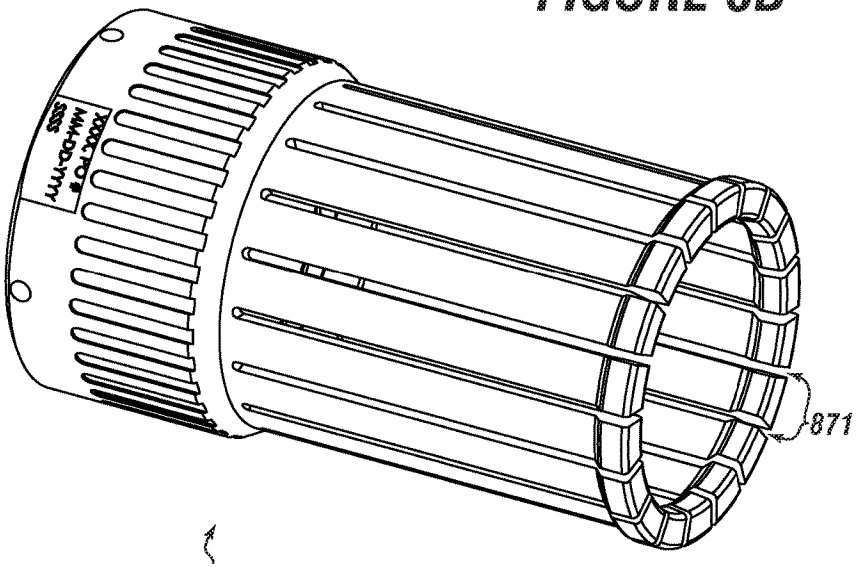
FIG. 8B shows an isometric view of the setting sleeve of FIG. 8A, according to embodiments of the disclosure.
Figure 8A:
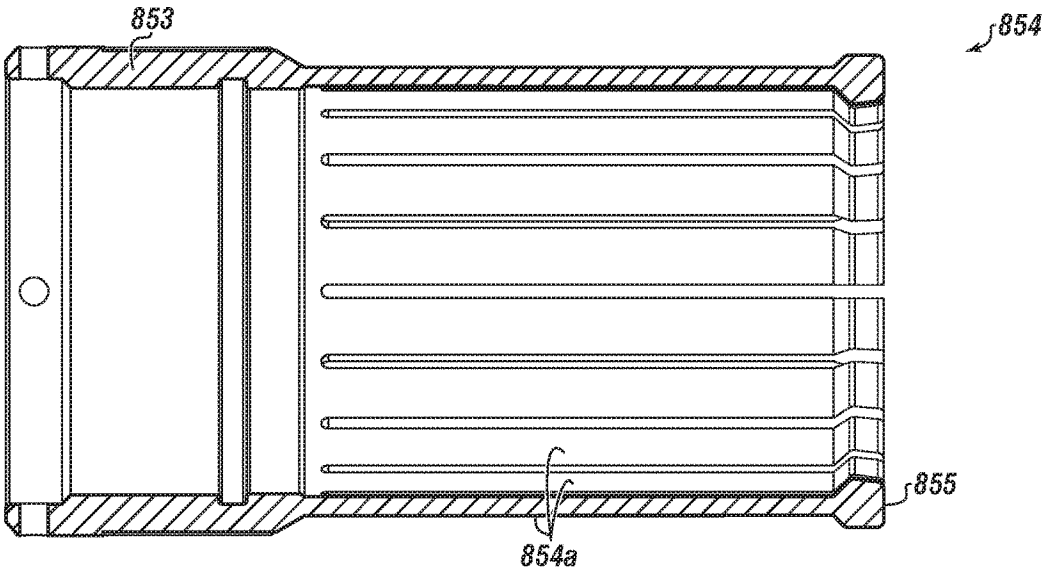
FIG. 8A shows a longitudinal side cross-sectional view of a setting sleeve, according to embodiments of the disclosure.

Briefly referring now to FIGS. 8A and 8B together, a longitudinal side cross-sectional view and an isometric view, respectively, of a setting sleeve usable with a downhole tool, in accordance with embodiments disclosed herein, are shown.

A setting tool assembly of the present disclosure may include or be associated with a setting sleeve 854. The setting sleeve 854 may be engaged with the downhole tool (or a component thereof) (e.g., 202). The setting sleeve 854 may be a rigid sleeve or may be flexible via one or more collets or dogs 854*a*. An upper end of the setting sleeve 854 may be configured to couple with a component of a setting tool, such as a barrel piston or an adapter. The sleeve 854 may have a lower end 855 configured to couple with a downhole tool (or a component thereof, such as a carrier ring).

Figure 9:
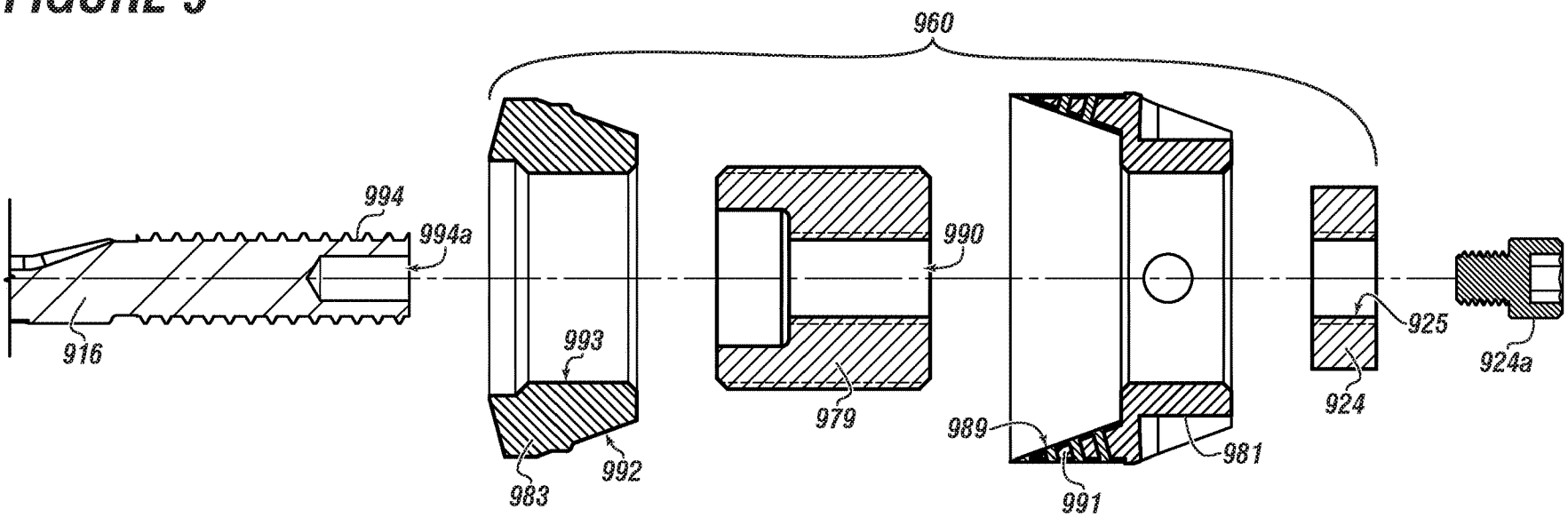
FIG. 9 shows a longitudinal side cross-sectional component breakout view of a guide assembly, according to embodiments of the disclosure.

Referring now to FIG. 9, a longitudinal side cross-sectional component breakout view of a guide assembly, in accordance with embodiments disclosed herein, is shown. The guide assembly 960 may be comparable or identical in aspects, function, operation, components, etc. as that of other guide assembly embodiments disclosed herein (e.g., 260). Similarities may not be discussed for the sake of brevity.

The guide assembly 960 may be just that—an assembly to help guide a downhole tool (e.g., 202) downhole. The guide assembly 960 may be a multi-component assembly having one or more of a support cone 983, a guide insert 979, a composite member 981, and a nose nut 924.

In an assembled or run-in position, an inner surface 989 of the composite member 981 may rest on a corresponding outer cone surface 992. As a result of the flexible nature of the deformable portion 691, fluid may 'catch' the portion 691 as the tool (202) is run in-hole.

An inner cone surface 993 may be configured for the guide insert 979 to engage therewith. The guide insert 979 may have its own inner guide passage 990 configured for a lower end 994 of a tension mandrel 916 to engage therewith. For example, the guide insert 979 and the lower end 994 may be threadingly connected. The threaded connection may be detachable, such as via shear threads. Either or both of the passage 990 and the lower end 994 may be configured with shear threads. The threaded connection may be a metal-to-composite material connection. The lower end 994 may also engage with an inner nut surface 925 of nut 924. There may be a nose bolt 924*a* configured to engage the lower end 994, such as in receptacle 994*a*.

The nut 924 may be configured and used to lock/jam against the guide insert 979, which may help prevent the insert 979 from unthreading off of the end 994. The nose bolt 924*a* may also be used to prevent the nut 924 from unthreading off of the end 994. The nose bolt 924*a* may have a head diameter larger than the tension mandrel 916 minor diameter, which may keep the nut 924 and the guide assembly 960 together. The engaged surfaces, such as the threads on end 994, may have a coating thereon, such as Loctite, or any other comparable adhesive, sealant, surface treatment, etc.

The connections described herein may help keep the guide assembly 960 coupled with the downhole tool (202) during assembly and run-in; after setting, which may include the disconnect of the lower end 994 from the assembly 960, the assembly 960 may fall away from engagement with the tool.

ADVANTAGES

Embodiments of the downhole tool are smaller in size, which allows the tool to be used in slimmer bore diameters. Smaller in size also means there is a lower material cost per tool. Because isolation tools, such as plugs, are used in vast numbers, and are generally not reusable, a small cost savings per tool results in enormous annual capital cost savings.

When downhole operations run about $30,000-$40,000 per hour, a savings measured in minutes (albeit repeated in scale) is of significance.

A synergistic effect is realized because a smaller tool means faster drilling time is easily achieved. Again, even a small savings in drill-through time per single tool results in an enormous savings on an annual basis. Further benefits may result in the event a dissolvable tool embodiment is used, as this eliminates drilling.

As the tool may be smaller (shorter), the tool may navigate shorter radius bends in well tubulars without hanging up and presetting. Passage through shorter tool has lower hydraulic resistance and can therefore accommodate higher fluid flow rates at lower pressure drop. The tool may accommodate a larger pressure spike (ball spike) when the ball seats.

While preferred embodiments of the disclosure have been shown and described, modifications thereof can be made by one skilled in the art without departing from the spirit and teachings of the disclosure. The embodiments described herein are exemplary only, and are not intended to be limiting. Many variations and modifications of the disclosure disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A downhole tool for use in a wellbore, the downhole tool comprising:
a double cone comprising:
a distal end; a proximate end; an outer surface; an inner flowbore disposed in the double cone, and extending therethrough from the proximate end to the distal end;
and a ball seat formed within the inner flowbore;
a carrier ring slidingly engaged with the proximate end, the carrier ring further comprising an annular outer seal element groove;
a slip engaged with the distal end; and
a guide assembly proximate the slip,
wherein the outer surface comprises a first angled surface and a second angled surface,
wherein a seal element is disposed in the annular outer seal element groove,
wherein the first angled surface comprises a first plane that in cross section bisects a longitudinal axis a first angle,
wherein the second angled surface comprises a second plane that in cross section bisects the longitudinal axis at a second angle negative to that of the first angle,
wherein in a set configuration, the carrier ring comprises an underside surface entirely in contact with the outer surface, and a ball is engaged against the ball seat.

2. The downhole tool of claim 1, wherein the first angle is in a first angle range of 5 degrees to 10 degrees, wherein the second angled is in a second angle range of 5 degrees to 40 degrees, and wherein the ball seat is defined by the inner flowbore having a first inner diameter smaller than a second inner diameter.

3. The downhole tool of claim 2, wherein the slip comprises an at least one slip groove that forms a lateral opening in the slip that is defined by a depth that extends from a slip outer surface to a slip inner surface, wherein the opening is void of material at a first slip end, and wherein the slip comprises an at least one insert.

4. The downhole tool of claim 3, wherein any component of the downhole tool is made of a dissolvable composite material.

5. The downhole tool of claim 3, wherein the carrier ring is configured to elongate by no more than 20% with respect to its original shape without fracturing, and wherein the inner flowbore comprises an inner diameter in a bore range of 0.5 inches to 5 inches.

6. The downhole tool of claim 5, wherein the guide assembly comprises shear threads, and wherein the seal element is not engaged by a cone.

7. The downhole tool of claim 6, wherein a longitudinal length of the downhole tool in the set configuration is in a set length range of about 5 inches to about 20 inches.

8. The downhole tool of claim 1, wherein when the ball is seated on the ball seat, the ball is not in contact with any other component of the downhole tool.

9. A downhole setting system for use in a wellbore, the system comprising:
a workstring;
a setting tool assembly coupled to the workstring, the setting tool assembly further comprising:
a tension mandrel comprising a first tension mandrel end and a second tension mandrel end; and
a setting sleeve;
a downhole tool comprising:
a double cone comprising:
a distal end; a proximate end; an outer surface; an inner flowbore disposed in the double cone, and extending therethrough from the proximate end to the distal end; and a ball seat formed within the inner flowbore;
a carrier ring slidingly engaged with the proximate end;
a slip engaged with the distal end; and
a guide assembly proximate the slip,
wherein the tension mandrel is disposed through the downhole tool, wherein a nose nut is engaged with the second tension mandrel end,
wherein the outer surface comprises a first angled surface and a second angled surface,
wherein the first angled surface comprises a first plane that in cross section bisects a longitudinal axis a first angle,
wherein the second angled surface comprises a second plane that in cross section bisects the longitudinal axis at a second angle negative to that of the first angle,
wherein the ball seat is defined by the inner flowbore having a first inner diameter smaller than a second inner diameter, and
wherein in a set configuration, the carrier ring comprises an underside surface entirely in contact with the outer surface, and a ball is engaged against the ball seat.

10. The downhole setting system of claim 9, wherein the first angle is in a first angle range of 5 degrees to 10 degrees.

11. The downhole setting system of claim 10, wherein the carrier ring is configured to elongate upward to 20% with respect to its original shape without fracturing.

12. The downhole setting system of claim 11, wherein the inner flowbore of the double cone comprises an inner diameter in a bore range of 1 inch to 6 inches.

13. The downhole setting system of claim 12, wherein a longitudinal length of the downhole tool in the set configuration is in a set length range of at least 5 inches to no more than 20 inches.

14. The downhole setting system of claim 9, wherein the slip comprises an at least one slip groove that forms a lateral opening in the slip that is defined by a depth that extends from a slip outer surface to a slip inner surface.

15. The downhole setting system of claim 14, wherein the slip comprises an at least one hollowed insert.

16. The downhole tool of claim 9, wherein when the ball is seated on the ball seat, the ball is not in contact with any other component of the downhole tool.

17. A downhole tool for use in a wellbore, the downhole tool comprising:
a double cone comprising:
a distal end; a proximate end; an outer surface; an inner flowbore disposed in the double cone, and extending therethrough from the proximate end to the distal end;
and a ball seat formed within the inner flowbore;
a carrier ring slidingly engaged with the proximate end, the carrier ring further comprising an annular outer seal element groove;
a slip engaged with the distal end; and
a guide assembly proximate the slip,
wherein the outer surface comprises a first angled surface and a second angled surface,
wherein a seal element is disposed in the annular outer seal element groove,
wherein in a set configuration, the carrier ring comprises an underside surface entirely in contact with the outer surface, and a ball is engaged against the ball seat, wherein the first angled surface comprises a first plane that in cross section bisects a longitudinal axis a first angle in a first angle range of 5 degrees to 10 degrees, wherein the second angled surface comprises a second plane that in cross section bisects the longitudinal axis at a second angle negative to that of the first angle and in a second angle range of 5 degrees to 40 degrees, and wherein the ball seat is defined by the inner flowbore having a first inner diameter smaller than a second inner diameter.

* * * * *